US005518873A

United States Patent [19]

Konishi et al.

[11] Patent Number: 5,518,873

[45] Date of Patent: May 21, 1996

[54] SILVER HALIDE LIGHT-SENSITIVE EMULSION AND SILVER HALIDE LIGHT-SENSITIVE MATERIAL

[75] Inventors: Ryutaro Konishi; Hiroshi Tamaoki; Masayuki Kuramitu; Hideo Ikeda; Katsuro Nagaoka, all of Kanagawa, Japan

[73] Assignee: Fuji Photo Film Co., Ltd., Kanagawa, Japan

[21] Appl. No.: 370,802

[22] Filed: Jan. 10, 1995

[30] Foreign Application Priority Data

Jan. 11, 1994 [JP] Japan ..... 6-001365

[51] Int. Cl.[6] ..... G03K 1/035

[52] U.S. Cl. ..... 430/567; 430/569; 430/603; 430/615

[58] Field of Search ..... 430/567, 569, 430/603, 615

[56] References Cited

U.S. PATENT DOCUMENTS

| | | | |
|---|---|---|---|
| 4,433,048 | 2/1984 | Solberg et al. | 430/569 |
| 4,636,461 | 1/1987 | Becker et al. | 430/569 |
| 4,766,058 | 8/1988 | Sampei et al. | 430/569 |

FOREIGN PATENT DOCUMENTS

| | | | |
|---|---|---|---|
| 58-113927 | 7/1983 | Japan | G03C 1/02 |
| 62-58237 | 3/1987 | Japan | G03C 1/02 |
| 62-187838 | 8/1987 | Japan | G03C 1/02 |

*Primary Examiner*—Mark F. Huff

*Attorney, Agent, or Firm*—Sughrue, Mion, Zinn, Macpeak & Seas

[57] ABSTRACT

A silver halide light-sensitive emulsion and a silver halide light-sensitive material containing the same are disclosed, in which silver halide emulsion grains composed of an internal nucleus of silver bromide or silver iodobromide having a silver iodide content of not more than 1 mol % having provided thereon, in the order described, a first coating layer of silver iodobromide having a silver iodide content of from 2 to 20 mol % and a second coating layer of silver iodobromide or silver bromide a silver iodide content of which is lower than that of said first coat and is not more than 3 mol %, and are further composed of iodide phrases which are formed by halogen conversion with an iodide ion, by addition of silver iodide fine grains or by addition of a silver ion and an iodide ion at any stage during formation of 3 to 97% of the total amount of silver and after completion of the formation of the second coating layer.

18 Claims, No Drawings

SILVER HALIDE LIGHT-SENSITIVE EMULSION AND SILVER HALIDE LIGHT-SENSITIVE MATERIAL

FIELD OF THE INVENTION

The present invention relates to a silver halide light-sensitive emulsion and a silver halide light-sensitive material which undergo reduced change in photographic performance due to stressing, exhibit high sensitivity, and have satisfactory latent image preservability and incubation resistance.

BACKGROUND OF THE INVENTION

Photographic materials having a silver halide emulsion layer are generally subject to various mechanical stresses. For example, a negative film for general photographing is bent on putting into a cartridge(patrone) in roll or loading into a camera or pulled on film winding.

Various stresses imposed on a light-sensitive material are transmitted to silver halide grains via gelatin as a binder for silver halide grains or a plastic film support. It is known that a stress imposed on silver halide grains induces a change in photographic performance of the light-sensitive material, as reported, e.g., in K. B. Mather, *J. Opt. Soc. Am.*, Vol. 38, p. 1054 (1948), P. Faelens and P. de Smet, *Sci. et Ind. Phot.*, Vol. 25, No. 5, p. 178 (1954), and P. Faelens, *J. Photo. Sci.*, Vol. 2, p. 103 (1954).

Various means have been studied to reduce the change in photographic performance due to stressing (hereinafter referred to as stress sensitiveness). For example, a means for reducing stress sensitiveness by making a difference in iodide content in the inside of individual grains, so-called an iodine gap, is disclosed in JP-A-59-99433, JP-A-60-35726, and JP-A-60-147727 (the term "JP-A" as used herein means an "unexamined published Japanese patent application"). Further, a technique for reducing stress sensitiveness while assuring satisfactory photographic sensitivity by making an iodine gap not only in the inside thereof but between a surface layer and an inside layer is disclosed in JP-A-62-123445. These means surely reduce change of photographic performance caused by the imposed stress but are accompanied by deterioration in latent image preservability and incubation resistance and are therefore unsatisfactory.

On the other hand, the idea of controlling the iodide distribution within individual-silver halide grains like the above-mentioned techniques has also been studied for the purpose of improving photographic characteristics other than reduced stress sensitiveness. For example, JP-A-58-113927 discloses a means for improving sensitivity, graininess and sharpness by providing a high iodide layer in the inside of grains. However, the silver halide grains according to this technique undergo significant change of fog during storage. JP-A-58-113927 discloses a tabular silver halide emulsion having an improved sensitivity to granularity ratio by increasing the iodide content on the outermost layer. However, the emulsion has turned out to have too poor latent image preservability to withstand practical use. JP-A-62-58237 discloses a means for improving preservability comprising providing an iodide conversion layer in the inside of individual grains thereby to prevent change of fog with time. This technique was still insufficient for improving latent image preservability.

While a variety of techniques have thus been attempted, they are to improve or enhance a part of the photographic performance but never to satisfy all the properties, such as reduced stress sensitiveness, sensitivity to granularity ratio, latent image preservability, incubation resistance, and so on.

SUMMARY OF THE INVENTION

An object of the present invention is to provide a silver halide light-sensitive emulsion and a silver halide light-sensitive material which- undergo reduced change in photographic performance on stressing while exhibiting high sensitivity, satisfactory latent image preservability, and satisfactory incubation resistance.

DETAILED DESCRIPTION OF THE INVENTION

The above object of the present invention is accomplished by:

(1) a silver halide light-sensitive emulsion comprising silver halide emulsion grains each comprising an internal nucleus of silver bromide or silver iodobromide having a silver iodide content of not more than 1 mol % having provided thereon, in the order described, a first coating layer of silver iodobromide having a silver iodide content of from 2 to 20 mol % and a second coating layer of silver iodobromide or silver bromide a silver iodide content of which is lower than that of said first coating layer and is not more than 3 mol %, said silver halide emulsion grains being characterized by two high iodide phases provided by halogen conversion by an iodide ion, by addition of silver iodide fine grains or by addition of a silver ion and an iodide ion, one of which is provided at any stage during formation of 3 to 97% of the total amount of silver, and the other after completion of the formation of the second coat;

(2) a silver halide light-sensitive emulsion as described in (1) above, characterized in that said silver halide grains have a total iodide content of not more than 5 mol %;

(3) a silver halide light-sensitive emulsion as described in (1) above, characterized in that said silver halide grains are cubic, tetradecahedral or octadecahedral;

(4) a silver halide light-sensitive emulsion as described in (1) above, characterized in that said silver halide grains have a coefficient of variation of size distribution of not more than 20%;

(5) a silver halide light-sensitive emulsion as described in (1) above, characterized in that said silver halide grains have been subjected to selenium sensitization;

(6) a silver halide light-sensitive emulsion as described in (1) above, characterized by using seed crystal grains for formation of the internal nucleus of said silver halide grains;

(7) a silver halide light-sensitive material having at least one silver halide emulsion layer on the support thereof, characterized in that at least one of silver halide emulsion layers contains the emulsion described in (1) above;

(8) a silver halide light-sensitive material having at least one silver halide emulsion layer on the support thereof, characterized in that at least one of silver halide emulsion layers contains the emulsion described in (2) above;

(9) a silver halide light-sensitive material having at least one silver halide emulsion layer on the support thereof, characterized in that at least one of silver halide emulsion layers contains the emulsion described in (3) above;

(10) a silver halide light-sensitive material having at least one silver halide emulsion layer on the support thereof, characterized in that at least-lone of silver halide emulsion layers contains the emulsion described in (4) above;

(11) a silver halide light-sensitive material having at least one silver halide emulsion layer on the support thereof, characterized in that at least one of silver halide emulsion layers contains the emulsion described in (5) above;

(12) a silver halide light-sensitive material having at least one silver halide emulsion layer on the support thereof, characterized in that at least one of silver halide emulsion layers contains the emulsion described in (6) above;

(13) a silver halide light-sensitive material as described in (7), characterized in that the layer containing the emulsion claimed in claim 1 contains a fogged emulsion;

(14) a silver halide light-sensitive material as described in (7), characterized in that said emulsion layer contains a compound represented by formula (1):

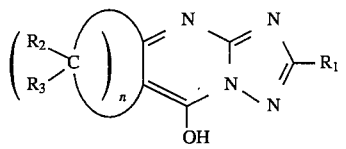

(1)

wherein $R_1$ represents a hydrogen atom, an aliphatic group, an aromatic group, a heterocyclic group, an amino group, a hydroxyl group, an alkoxy group, an alkylthio group, a carbamoyl group, a halogen atom, a cyano group, a carboxyl group or an alkoxycarbonyl group; $R_2$ and $R_3$ each represents a hydrogen atom, an aliphatic group, an aromatic group or a heterocyclic group; and n represents an integer of 3 to 5; and

(15) a silver halide light-sensitive material having at least one silver halide emulsion layer on the support thereof, characterized in that at least one of the silver halide emulsion layers contains the emulsion described in claim (1) above and that a layer farther from the support than a unit having the same color sensitivity including said silver halide emulsion layer contains a tabular silver halide emulsion.

The present invention will be described below in more detail.

In the present invention, the size of silver halide grains is expressed in terms of projected area diameter. The terminology "projected area diameter" as used herein means a diameter of a circle whose area is equal to the projected area of a grain.

The silver halide grains of the present invention preferably range from 0.1 to 2.0 μm, more preferably 0.15 to 1.0 μm, and most preferably 0.2 to 0.7 μm.

Internal nuclear grains which can be used in the present invention are prepared by known methods as described in P. Grafkides, *Chemie et Physique Photographique*, Paul Montel (1967), G. F. Duffin, *Photographic Emulsion Chemistry*, Focal Press (1966), and V. L. Zelikman, et al., *Making and Coating Photographic Emulsion*, Focal Press (1964). In some detail, any of an acid process, a neutral process, and an ammonia process may be used. The mode of reaction between a soluble silver salt and a soluble halogen salt includes a single jet process, a double jet process, and a combination thereof. A so-called reverse mixing process in which silver halide grains are formed in the presence of excess silver ions may be used. A so-called controlled double jet process, a modified process of a double jet process, in which a pAg value of a liquid phase where silver halide grains are formed is maintained constant may also be employed. According to this process, a silver halide emulsion having a regular crystal form and a nearly uniform grain size can be obtained.

The internal nuclei may have a tabular shape, a spherical shape, a twin shape, an octahedral shape, a cubic shape, a tetradecahedral shape, or a composite shape thereof.

The internal nuclei may have either a monodispersed system or a polydispersed system, with a monodispersed system being preferred.

In order to form a uniform grain size, it is preferable to make grains grow as rapidly as possible by changing an additional rate of an aqueous silver nitrate solution or an aqueous alkali halide solution in conformity with a rate of grain growth as described in British Patent 1535016, JP-B-58-36890, and JP-B-52-16364 (the term "JP-B" as used herein means an "examined published Japanese patent application") or by changing a concentration of the aqueous solutions as described in U.S. Pat. No. 4,242,445 or JP-A-55-158124 within such a range that the grain formation system may not exceed the critical degree of supersaturation. Since these techniques achieve uniform formation of a coating layer on individual silver halide grains without inducing re-nucleation, they are used preferably for formation of a first coating layer and a second coating layer hereinafter described.

Growth of internal nuclei is preferably conducted by starting with a seed emulsion. The seed emulsion can be formed by the above-described methods. A previously prepared seed emulsion may be subjected to desalting before use.

Where the internal nuclei comprise silver iodobromide, it is preferable for enhancing the effects of the present invention that the grains have a homogeneous solid solution phase. The term "homogeneous" as used herein means such a silver iodide content distribution that the silver iodide content of 95 mol % of the silver halide of an internal nucleus falls within ±40% of the mean silver iodide content.

The internal nuclei preferably have a mean silver iodide content of from 0 up to 1 mol %, more preferably 0 to 0.5 mol %, most preferably 0 to 0.3 mol %.

The proportion of the silver of the internal nuclei in the total silver of the whole grains is preferably 1 to 95%, more preferably 2 to 85%, most preferably 2 to 60%.

The first coating layer has a silver iodide content of 2 to 20 mol %, preferably 2 to 10 mol %, still preferably 2 to 5 mol %.

The proportion of the silver of the first coating layer in the total silver of the whole grain is 1 to 90%, preferably 5 to 85%, still preferably 10 to 80%, and most preferably 20 to 80%.

Where the second coating layer comprises silver iodobromide, it is preferable, while not essential, that the second coating layer is homogeneous.

It is required that the second coating layer should cover the first coating layer sufficiently. To this effect, the second coating layer preferably has an average thickness of 0.01 μm or more, still more preferably 0.02 μm or more, and most preferably 0.04 μm or more.

The second coating layer has a silver iodide content of from 0 to 3 mol %, preferably 0 to 2 mol %, still more preferably 0 to 1 mol % and, most preferably 0 to 0.5 mol %.

The proportion of the silver of the second coat in the total silver of the whole grain is preferably from 2 to 90%, still preferably 5 to 80%, and most preferably 10 to 60%.

In the present invention, a high iodide phase is provided (1) at any stage during formation of 3 to 97% of the total silver and (2) after completion of the formation of the second coating layer by (i) halogen conversion by an iodide ion, (ii) addition of silver iodide fine grains, or (iii) addition of a silver ion and an iodide ion.

The high iodide phase which is provided first is provided at any arbitrary stage while 3 to 97% of the total silver is being formed, preferably after formation of the internal nucleus and during the formation of the second coating layer, still more preferably after formation of the first coating layer and before formation of the second coat. The amount of an iodide to be added preferably ranges from 0.1 to 5%, still more preferably from 0.3 to 2.0%, most preferably from 0.3 to 1.5 mol %, based on the total silver content of the whole silver halide grain.

Halogen conversion by an iodide ion can be effected by addition of a halogen solution containing an iodide ion (which may contain a bromide ion, a chloride ion, etc. as long as the effects of the present invention are not impaired). Epitaxial joining as described in JP-A-59-133540, JP-A-58-108526 and JP-A-59-162540 is useful. In carrying out the iodide localization, a choice of the following conditions is effective to obtain a uniform silver iodide content among individual grains. That is, the pAg before addition of an iodide is preferably between 8.5 and 10.5, still more preferably between 9.0 and 10.5, and the temperature is preferably kept between 30° and 50° C.

The iodide ion concentration to be added is preferably low, specifically not higher than 0.2M.

In the case of adding silver iodide fine grains, the fine grains preferably have a grain size of 0.02 to 0.2 μm. From the standpoint of facilitation of Ostwald ripening and stabilization of the silver iodide grains per se, a still more highly preferred grain size is from 0.02 to 0.1 μm.

Where a silver ion and an iodide ion are added simultaneously, conditions such as rate of addition, pAg and temperature should be selected so that the silver iodide content distribution among grains may be narrowed.

Of the above-mentioned three methods for providing a high iodide phase, the halogen conversion method is preferred.

The second high iodide phase which is provided outside the second coating layer may be provided before, during or after chemical sensitization. When an iodide conversion method or a method of adding silver iodide fine grains is used, the high iodide phase is preferably provided during the latter half of chemical ripening or after completion of chemical ripening and before addition of a sensitizing dye.

The iodide is added in an amount preferably of from 0.005 to 3 mol %, still more preferably from 0.01 to 2 mol %, most preferably from 0.05 to 1 mol %, based on the total silver content of silver halide grains.

The second high iodide phase can be provided by the methods described for the first high iodide phase. The halogen conversion method using an iodide ion is the most preferred.

The silver halide emulsion according to the present invention preferably has an average silver iodide content of less than 6 mol %, still more preferably not more than 5 mol %, and most preferably not more than 4.5 mol %.

The relative standard deviation of the iodide distribution among silver halide emulsion grains is not particularly limited but is preferably not more than 50%, still more preferably not more than 40%.

A silver iodide content of individual emulsion grains can be measured by analyzing the composition of the individual grains by means of an X-ray microanalyzer. The terminology "relative standard deviation of a silver iodide content among individual grains" as used herein means a value obtained by multiplying (a quotient obtained by dividing (a standard deviation of silver iodide content) by (a mean silver iodide content)) by 100, the silver iodide content measurement being made on at least 100 emulsion grains with, for example, an X-ray microanalyzer. The method for measuring the silver iodide content of individual emulsion grains is described, e.g., in EP 147868 A.

If the relative standard deviation of silver iodide content among individual grains is large, the optimum point of chemical sensitization varies among the individual grains so that it is impossible to derive the performance of all the emulsion grains. In addition, the relative standard derivation of the number of dislocations among grains also tends to increase.

Some individual grains have a correlation between silver iodide content Yi (mol %) and sphere-equivalent diameter Xi (μm) and some do not. It is desirable that there is no correlation between them.

The structure of the grains with reference to halogen composition can be confirmed by, for example, a combination of X-ray diffractometry, EPMA (also called XMA, a method in which silver halide grains are scanned by an electron beam to detect the silver halide composition), and ESCA (also called XPS, a method in which grains are irradiated with X-rays, and photoelectrons emitted are spectroscopically analyzed).

The silver halide grains of the present invention have a wide range of grain size, including from fine grains of about 0.1 μm or smaller to large grains having a projected area diameter reaching about 10 μm. The silver halide emulsion may be either an emulsion having a narrow grain size distribution or an emulsion having a broad grain size distribution, and a mono-dispersed emulsion is preferred for improving graininess.

Silver halide grains include so-called regular grains having a regular crystal form, such as a cubic form, an octahedral form or a tetradecahedral form; those having an irregular crystal form, such as a spherical form and a tabular form; those having a crystal defect such as a twinning plane, and those having a composite form of these crystal forms. Among them regular grains are particularly preferred. A mixture of various crystal forms may be employed.

Regular grains may be those having slightly rounded apexes as described in JP-B-4-30572, JP-A-59-140443, JP-A-59-149344, and JP-A-59-149345.

Mono-dispersed emulsions typically include emulsions in which at least 95% by weight of emulsion grains have a size falling within ±40% of the mean diameter. Emulsions in which at least 95% by the weight or the number of grains have a size falling within ±20% of the mean grain diameter are preferably used in the present invention. The size still more preferably falls within ±15%, particularly ±10%, of the mean grain diameter. Methods for preparing such emulsions are described, e.g., in U.S. Pat. Nos. 3,574,628 and 3,655,394 and British Patent 1,413,748. The mono-dispersed emulsions described in JP-A-48-8600, JP-A-51-39027, JP-A-51-83097, JP-A-53-137133, JP-A-54-48521, JP-A-54-99419, JP-A-58-37635, and JP-A-58-49938 are also used in the present invention for preference.

The silver halide emulsion of the present invention can contain a polyvalent metal, such as iridium, rhodium or lead, added during the grain formation.

For example, iridium is added for improvement of reciprocity law failure. The amount of iridium to be added varies depending on the kind and size of silver halide grains and preferably not more than $10^{-5}$ mol, still more preferably $10^{-7}$ to $10^{-5}$ mol, per mol of silver halide.

The silver halide emulsion of the present invention can be subjected to chemical sensitization. Chemical sensitization can be carried out by, for example, using active gelatin as described in T. H. James, *The Theory of Photographic Process,* 4th Ed., pp. 67–77, Macmillan (1977) or by using sulfur, selenium, tellurium, gold, platinum, palladium, iridium or a combination of these sensitizers at a pAg of 5 to 10, a pH of 5 to 8 and a temperature of 30° to 80° C. as described in *Research Disclosure*, Vol. 120, No. 12008 (April, 1974), ibid, Vol. 34, No. 13452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally carried out in the presence of a gold compound and a thiocyanate compound, or, as described in U.S. Pat. Nos. 3,857,711, 4,266,018 and 4,054,457 in the presence of a sulfur-containing compound, such as Hypo, a thiourea compound or a rhodanine compound. Chemical sensitization can also be conducted in the presence of a chemical sensitization assistant. Useful chemical sensitization assistants include compounds known to inhibit fogging and to increase sensitivity in the course of chemical sensitization, such as azaindene compounds, azapyridazine compounds and azapyrimidine compounds. Examples of chemical sensitization assistant modifiers are shown in U.S. Pat. Nos. 2,131,038, 3,411,914, and 3,554,757, JP-A-58-126526, and G. F. Duffin, *Photographic Emulsion Chemistry*, pp. 138–143. Chemical sensitization may be combined with or replaced with reduction sensitization using, for example, hydrogen as described in U.S. Pat. Nos. 3,891,446 and 3,984,249. Reduction sensitization can also be carried out by using a reducing agent, such as stannous chloride, thiourea dioxide or a polyamine, as described in U.S. Pat. Nos. 2,518,698, 2,743,182, and 2,743,183 or by treating at a low pAg (e.g., lower than 5) and/or at a high pH (e.g., higher than 8). Color sensitivity may be improved by the method of chemical sensitization described in U.S. Pat. Nos. 3,917,485 and 3,966,476.

A method of sensitization using an oxidizing agent as described in JP-A-61-3134 and JP-A-61-3136 can also be applied.

Chemical sensitization using a selenium compound is preferably applied to the emulsion of the present invention.

Selenium sensitization of the silver halide emulsion of the present invention can be carried out in a conventional manner. That is, it is usually performed by adding a labile selenium compound and/or a non-labile selenium compound to the emulsion and stirring the system for a given period of time at a high temperature, preferably 40° C. or higher. Selenium sensitization using the labile selenium sensitizers described in JP-B-44-15748 is preferably used. Specific examples of the labile selenium sensitizers are aliphatic isoselenocyanates, such as allyl isoselenocyanate, selenoureas, selenoketones, selenoamides, selenocarboxylic acids and their esters, and selenophosphates. Particularly preferred labile selenium compounds are shown below.

I. Colloidal metallic selenium

II. Organoselenium compounds (organic compounds with a selenium atom bonded to the carbon atom thereof via a covalent double bond):

a. Isoselenocyanates, such as aliphatic isoselenocyanates, e.g., allyl isoselenocyanate.

b. Selenoureas (inclusive of enol type compounds), such as aliphatic selenoureas containing an aliphatic group, e.g., methyl, ethyl, propyl, isopropyl, butyl, hexyl, octyl, dioctyl, tetramethyl, N-(β-carboxyethyl)-N',N'-dimethyl, N,N-dimethyl, diethyl or dimethyl; aromatic selenoureas containing one or more aromatic groups, e.g., phenyl or tolyl; and heterocyclic selenoureas containing a heterocyclic group, e.g., pyridyl or benzothiazolyl.

c. Selenoketones, such as selenoacetone, selenoacetophenone, a selenoketone having an alkyl group bonded to —C(=Se)—, and selenobenzophenone.

d. Selenoamides, such as selenoacetamide.

e. Selenocarboxylic acid and esters thereof, such as 2-selenopropionic acid, 3-selenobutyric acid, and methyl 3-selenobutyrate.

III. Others:

a. Selenides, such as diethyl selenide, diethyl diselenide, triphenylphosphine selenide and pentafluorophenyldiphenylphosphine selenide.

b. Selenophosphates, such as tri-p-tolyl selenophosphate and tri-n-butyl selenophosphate.

These compounds are preferred types of labile selenium compounds and are not limiting. The structure of a labile selenium compound as a sensitizer for photographic emulsions is not so important to those skilled in the art as long as the selenium atom is labile in the structure. It is generally accepted that the organic moiety of a selenium sensitizer molecule serves for nothing but as a support for selenium to make it exist in an emulsion in an unstable form. In the present invention, labile selenium compounds included in such a broad sense are used to advantage.

Selenium sensitization using a non-labile selenium sensitizer as described in JP-B-46-4553, JP-B-52-34492 and JP-B-52-34491 is also employable. Useful non-labile selenium compounds include selenious acid, potassium selenocyanide, selenazole compounds, a quaternary ammonium salt of selenazole compounds, diaryl selenides, diaryl diselenides, 2-thioselenazolidinedione, 2-selenoxazolidinethione, and derivatives thereof.

The non-labile selenium sensitizers (thioselenazolidinedione compounds) described in JP-B-52-38408 are also effective.

These selenium sensitizers are added to an emulsion at the time of chemical sensitization in the form of a solution in water or an organic solvent, such as methanol or ethanol, or a mixture thereof. They are preferably added before the commencement of chemical sensitization other than selenium sensitization. These selenium sensitizers may be used either individually or in combination of two or more thereof. A combined use of a labile selenium compound and a non-labile selenium compound is preferred.

The amount of the selenium sensitizer to be added varies depending on the activity of the selenium sensitizer, the kind or size of silver halide, and the temperature or time of ripening and is preferably at least $1\times10^{-8}$ mol, still preferably from $1\times10^{-7}$ to $5\times10^{-5}$ mol, per mol of silver halide. In using a selenium sensitizer, the temperature of chemical ripening is preferably not lower than 45° C., still more preferably from 50° to 80° C.

While arbitrary, the pAg during the ripening using a selenium sensitizer is preferably not lower than 7.5, still more preferably 8.0 or higher. The pH, while also arbitrary, is preferably not higher than 7.5, still preferably 6.8 or lower. While either one of the pAg and pH conditions may be satisfied, it is preferable to satisfy both of them.

Silver halide solvents which can be used in the present invention include (a) organic thioethers described, e.g., in U.S. Pat. Nos. 3,271,157, 3,531,289, and 3,574,628, JP-A-

54-1019 and JP-A-54-158917, (b) thiourea derivatives described, e.g., in JP-A-53-82408, JP-A-55-7773, JP-A-52-2982, (c) silver halide solvents having a thiocarbonyl group caught between an oxygen atom or a sulfur atom and a nitrogen atom described in JP-A-53-144319, (d) imidazoles described in JP-A-54-100717, (e) sulfites, and (f) thiocyanates. Specific examples of these compounds are shown below.

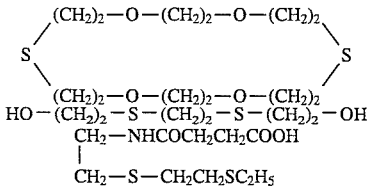
(a)

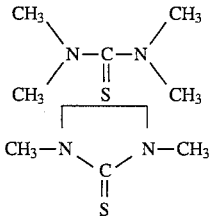
(b)

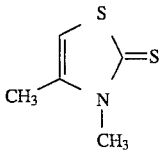
(c)

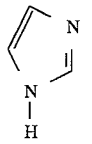
(d)

$K_2SO_3$ (e)

$NH_4SCN$ (f)
KSCN

Particularly preferred of them are thiocyanates and tetramethylthiourea. The amount of the solvent to be used depends on the kind. A thiocyanate, for example, is preferably used in an amount of from $1\times10^{-4}$ to $1\times10^{-2}$ mol per mol of silver halide.

It is desirable that the silver halide grains of the present invention are chemically sensitized by sulfur sensitization and/or gold sensitization in addition to selenium sensitization.

Sulfur sensitization is usually carried out by adding a sulfur sensitizer to an emulsion, followed by stirring for a given period of time at a high temperature, preferably 40° C. or higher.

Gold sensitization is usually performed by adding a gold sensitizer to an emulsion, followed by stirring for a given period of time at a high temperature, preferably 40° C. or higher.

The sulfur sensitization can be effected using any of known sulfur sensitizers, such as thiosulfates, allylthiocarbamidethiourea, allyl isothiocyanate, cystine, ptoluenethiosulfonates, and rhodanine. Additionally, those described in U.S. Pat. Nos. 1,574,944, 2,410,689, 2,278,947, 2,728,668, 3,501,313, and 3,656,955, German Patent 1,422,869, JP-B-56-24937, and JP-A-55-45016 are also useful.

The sulfur sensitizer is added in an amount enough to increase the sensitivity of an emulsion effectively. Such an amount varies depending on various conditions, such as pH, temperature, and size of silver halide grains. It preferably ranges from $1\times10^{-7}$ to $5\times10^{-5}$ mol per mol of silver halide.

The oxidation number of gold in gold sensitizers to be used for gold sensitization may be +1 or +3, and gold compounds generally employed as gold sensitizers may be used. Typical examples of gold sensitizers are chloroaurates, e.g., potassium chloroaurate, and auric trichloride, potassium auric thiocyanate, potassium iodoaurate, tetracyanoauric acid, ammonium aurothiocyanate, and pyridyltrichlorogold.

The amount of the gold sensitizer to be added varies according to various conditions. It is preferably from $1\times10^{-7}$ to $5\times10^{-5}$ mol per mol of silver halide.

In carrying out chemical ripening, the time or order of addition of a silver halide- solvent and/or a selenium sensitizer and/or a sulfur sensitizer and a gold sensitizer, etc. is not particularly restricted. For example, these compounds may be added either simultaneously or at different stages in the initial stage of chemical ripening or, for preference, during the progress of chemical ripening. These compounds may be added as dissolved in water or a water-miscible organic solvent, such as methanol, ethanol or acetone, or a mixture thereof.

The emulsions of the present invention may have their surface or any portion under the surface chemically sensitized, and preferably have their surface chemically sensitized. Where the inside is to be chemically sensitized, the method described in JP-A-63-264740 can be referred to.

The silver halide grains of the present invention may be subjected to reduction sensitization during grain formation or chemical sensitization.

To conduct reduction sensitization during grain formation basically means to conduct reduction sensitization during nucleation, ripening and growth. Reduction sensitization may be carried out at any stage of nucleation (the initial stage of grain formation), physical ripening and growth. In a most preferred embodiment, reduction sensitization is conducted during growth of silver halide grains. The term "during growth" as used herein includes an embodiment in which reduction sensitization is conducted while silver halide grains are growing by physical ripening or by addition of a water-soluble silver salt and a water-soluble alkali halide and an embodiment in which the growth is once stopped to conduct reduction sensitization and resumed after the reduction sensitization.

For carrying out reduction sensitization, any one or more than one method can be selected from a method of adding a known reducing agent to a silver halide emulsion, a method of allowing silver halide grains to grow or ripen in a low pAg atmosphere having a pAg of 1 to 7 (called silver ripening), and a method of allowing silver halide grains to grow or ripen in a high pH atmosphere having a pH of 8 to 11 (called high pH ripening).

The method of adding a reduction sensitizer is a preferred method because the level of reduction sensitization can be finely adjusted.

Known reduction sensitizers include stannous salts, amines or polyamines, hydrazine derivatives, formamidinesulfinic acid, silane compounds, and borane compounds. Reduction sensitizers to be used in the present invention are selected from these known compounds. Two or more of these compounds may be used in combination. Preferred of them are stannous chloride, thiourea dioxide, dimethylamineborane, ascorbic acid, and ascorbic acid derivatives. While the amount of the reduction sensitizer is decided depending on the conditions of emulsion preparation, a suitable range is from $10^{-8}$ to $10^{-3}$ mol per mol of silver halide.

The reduction sensitizer can be added as dissolved in a solvent, such as water, an alcohol, a glycol, a ketone, an ester or an amide, during grain formation. It may be added to the reaction vessel beforehand but is preferably added in an appropriate stage during grain formation. The reduction sensitizer may previously be added to an aqueous solution of a water-soluble silver salt or a water-soluble alkali halide, and grain formation may be effected using these aqueous solutions. It is also preferable to add a solution of a reduction sensitizer continuously or in several divided portions with the progress of grain formation.

Methine dyes are usually used as a sensitizing dye in the present invention. Methine dyes include cyanine dyes, merocyanine dyes, complex cyanine dyes, complex merocyanine dyes, holopolar cyanine dyes, hemicyanine dyes, styryl dyes, and hemioxonol dyes. Any of nuclei commonly employed in cyanine dyes as a basic heterocyclic nucleus is applicable to these dyes. Included in such nuclei are pyrroline, oxazoline, thiazoline, pyrrole, oxazole, thiazole, selenazole, imidazole, tetrazole, and pyridine nuclei; the above-enumerated nuclei to each of which an alicyclic hydrocarbon ring is fused; and the above-enumerated nuclei to each of which an aromatic hydrocarbon ring is fused, e.g., indolenine, benzindolenine, indole, benzoxazole, naphthoxazole, benzothiazole, naphthothiazole, benzoselenazole, benzimidazole, and quinoline nuclei. These nuclei may have a substituent(s) on the carbon atom(s) thereof.

To merocyanine dyes or complex merocyanine dyes is applicable a 5- or 6-membered heterocyclic ring as a nucleus having a ketomethylene structure, e.g., pyrazolin-5-one, thiohydantoin, 2-thiooxazoline-2,4-dione, thiazoline-2,4-dione, rhodanine, and thiobarbituric acid nuclei.

Of these dyes particularly useful are cyanine dyes. Examples of cyanine dyes useful in the present invention include those represented by formula (2):

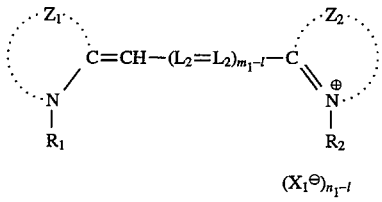

(2)

In the formula, $Z_1$ and $Z_2$ each represents an atomic group necessary to form a heterocyclic nucleus generally used in cyanine dyes, particularly a thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazole, selenazoline, benzoselenazole, naphthoselenazole or indolenine nucleus. These nuclei may be substituted with a halogen atom, a lower alkyl group, e.g., methyl, a phenyl group, a hydroxyl group, an alkoxy group having 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, or a nitro group.

$L_1$ and $L_2$ each represents a methine group or a substituted methine group. The substituted methine group includes a methine group substituted with, for example, a lower alkyl group, e.g., methyl or ethyl, a phenyl group, a substituted phenyl group, a methoxy group or an ethoxy group.

$R_1$ and $R_2$ each represent an alkyl group having 1 to 5 carbon atoms; a substituted alkyl group having a carboxyl group; a substituted alkyl group having a sulfo group, e.g., β-sulfoethyl, γ-sulfopropyl , δ-sulfobutyl , 2-(3-sulfopropoxy)ethyl, 2-(2-(3-sulfopropoxy)ethoxy)ethyl, or 2-hydroxysulfopropyl; an allyl group; or a substituted alkyl group generally used in cyanine dyes as an N-substituent. $m_1$ represents 1, 2 or 3. $X_1$— represents an acid anion group generally used in cyanine dyes, such as an iodide ion, a bromide ion, a p-toluenesulfonate ion or a perchlorate ion. $n_1$ represents 1 or 2. Where the compound has a betaine structure, $n_1$ is 1.

Spectral sensitization is preferably conducted using two or more kinds of the sensitizing dyes of formula (2).

Other useful spectral sensitizing dyes are described in German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, 4,026,344, 1,242,588, 1,344,281, and 1,507,803, JP-B-44-14030, JP-B-52-24844, JP-B-43-4936, JP-B-53-12375, JP-A-52-110618, JP-A-52-109925, and JP-A-50-80827.

The spectral sensitizing dyes described in JP-A-4- 362930 preferably used for the silver halide emulsion of the present invention.

The spectral sensitizing dyes described in JP-A-5-127293 and JP-A-5-127291 are also preferably used for the silver halide emulsion of the present invention.

While the amount of sensitizing dyes to be added in the preparation of a silver halide emulsion depends on the kind of additives or the amount of silver halide and cannot be generally specified, the sensitizing dyes are used in amounts used in conventional methods, i.e., from 50 to 80% of a saturated adsorption.

In other words, a preferred amount of a sensitizing dye is 0.001 to 100 mmol, still preferably 0.01 to 10 mmol, per mol of silver halide.

The sensitizing dye is added after or before chemical ripening. It is most preferred for the silver halide grains according to the present invention that the sensitizing dye be added during chemical ripening or before chemical ripening (e.g., at the time of grain formation or before physical ripening).

The emulsion may contain, in combination with the sensitizing dye, a dye having no spectral sensitizing action by itself or a substance which absorbs substantially no visible light and yet exhibits supersensitization. For example, the emulsion may contain an aminostilbene compound (e.g., the compound described in U.S. Pat. Nos. 2,933,390 and 3,635,721), an aromatic organic acid-formaldehyde condensate (e.g., the compound described in U.S. Pat. No. 3,743,510), a cadmium salt, or an azaindene compound. The combinations described in U.S. Pat. Nos. 3,615,613, 3,615,641, 3,617,295, and 3,635,721 are particularly useful.

For prevention of fog during preparation, preservation or photographic processing of a light-sensitive material or for stabilization of photographic properties of a light-sensitive material, various compounds can be introduced into the photographic emulsion of the present invention. Such compounds include azoles, such as benzothiazolium salts, nitroindazoles, triazoles, benzotriazoles, and benzimidazoles (especially, nitro- or halogen-substituted benzimidazoles); heterocyclic mercapto compounds, such as mercaptothiazoles, mercaptobenzothiazoles, mercaptobenzimidazole, mercaptotetrazoles (especially 1-phenyl-5-mercaptotetrazole), and mercaptopyrimidines; the -above-described heterocyclic mercapto compounds having a water-soluble group, e.g., a carboxyl group or a sulfone group; thioketo compounds, such as oxazolinethione; azaindenes, such as tetraazaindenes (especially 4-hydroxy-substituted (1,3,3a, 7)-tetraazaindenes); benzenethiosulfonic acids; benzenesulfinic acids; and many other compounds known as antifoggants or stabilizers.

These antifoggants or stabilizers are usually added after chemical sensitization, preferably during chemical ripening or any stage before the commencement of chemical ripening. That is, they may be added in the stage of silver halide grain formation and during the addition of a silver salt solution, or after the addition up to the commencement of chemical ripening, or during chemical ripening (preferably from the beginning to 50% chemical ripening, still preferably to 20% chemical ripening).

It is preferable that the layer containing the emulsion of the present invention further contains a compound represented by formula (1):

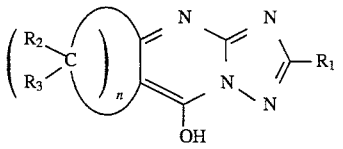

(2)

In the formula, $R_1$ represents a hydrogen atom, an aliphatic group, an aromatic group, a heterocyclic group, an amino group, a hydroxyl group, an alkoxy group, an alkylthio group, a carbamoyl group, a halogen atom, a cyano group, a carboxyl group or an alkoxycarbonyl group; $R_2$ and $R_3$ each represent a hydrogen atom, an aliphatic group, an aromatic group or a heterocyclic group; and n represents an integer of 3 to 5.

In formula (1), the aliphatic group as represented by $R_1$ preferably includes those containing 1 to 30 carbon atoms, and still preferably straight-chain, branched or cyclic alkyl, alkenyl, alkynyl or aralkyl groups having 1 to 20 carbon atoms. The alkyl, alkenyl, alkynyl and aralkyl groups include methyl, ethyl, isopropyl, t-butyl, n-octyl, n-decyl, n-hexadecyl, cyclopropyl, cyclopentyl, cyclohexyl, allyl, 2-butenyl, 3-pentenyl, propargyl, 3-pentynyl, and benzyl groups.

In formula (1), the aromatic group as represented by $R_1$ preferably includes those containing 6 to 30 carbon atoms, still preferably monocyclic or condensed ring aryl groups having 6 to 20 carbon atoms, such as a phenyl group and a naphthyl group.

In formula (1), the heterocyclic group as represented by $R_1$ is a 3- to 10-membered saturated or unsaturated heterocyclic group containing at least one of a nitrogen atom, an oxygen atom and a sulfur atom. The heterocyclic group may be monocyclic or may form a condensed ring together with other aromatic rings. The heterocyclic group preferably includes aromatic heterocyclic groups having 5 or 6 carbon atoms, such as a pyridyl group, an imidazolyl group, a quinolyl group, a benzimidazolyl group, a pyrimidyl group, a pyrazolyl group, an isoquinolinyl group, a thiazolyl group, a thienyl group, a furyl group, and a benzothiazolyl group.

In formula (1), the amino group as represented by $R_1$ may be substituted. Examples of the substituents include an alkyl group (e.g., methyl, ethyl or butyl) and an acyl group (e.g., acetyl or methanesulfonyl). Specific examples of the substituted amino group are a dimethylamino group, a diethylamino group, a butylamino group, and an acetylamino group.

In formula (1), the alkoxy group as represented by $R_1$ includes a methoxy group, an ethoxy group, a butoxy group, and a heptadecyloxy group.

In formula (1), the alkylthio group as represented by $R_1$ includes a methylthio group, an ethylthio group, and a butylthio group.

In formula (1), the carbamoyl group as represented by $R_l$ may have one or two substituents selected from an alkyl group having 1 to 20 carbon atoms and an aryl group. Specific examples of the substituted carbamoyl group are a methylcarbamoyl group, a dimethylcarbamoyl group, an ethylcarbamoyl group, and a phenylcarbamoyl group.

In formula (1), the alkoxycarbonyl group as represented by $R_1$ includes a methoxycarbonyl group, an ethoxycarbonyl group, and a butoxycarbonyl group.

In formula (1), the halogen atom as represented by $R_1$ includes a fluorine atom, a chlorine atom, a bromine atom, and an iodine atom.

In formula (1), $R_2$ and $R_3$ may be the same or different. The aliphatic, aromatic or heterocyclic group as represented by $R_2$ and $R_3$ has the same meaning as $R_1$.

It is preferable that in formula (1) $R_1$ represents a hydrogen atom, an alkyl group, an aryl group or an alkylthio group; $R_2$ and $R_3$ represent a hydrogen atom; and n represents 3 or 4.

It is still preferable that in formula (1) $R_1$ represents a hydrogen atom, an alkyl group or an alkylthio group; $R_2$ and $R_3$ represent a hydrogen atom; and n represents 3 or 4.

Specific examples of the compounds of the present invention are shown below, but the compounds of the present invention are not limited to these examples.

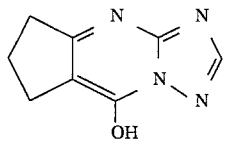

A-1

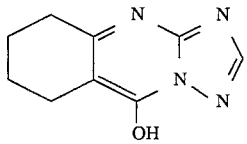

A-2

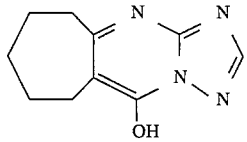

A-3

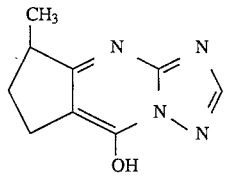

A-4

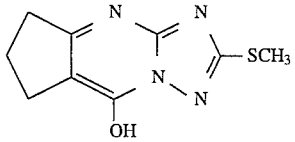

A-5

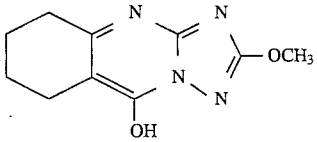

A-6

-continued

A-7

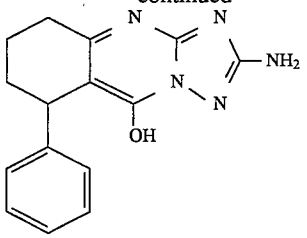

A-8

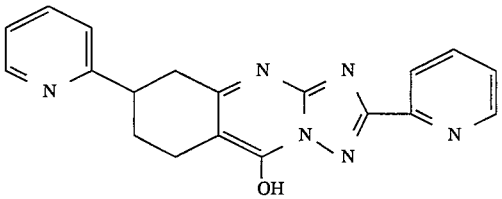

A-9

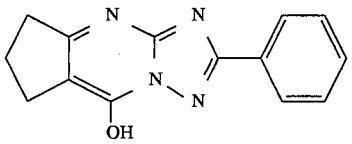

A-10

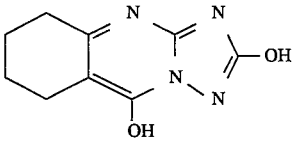

A-11

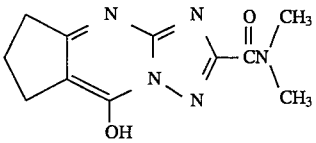

A-12

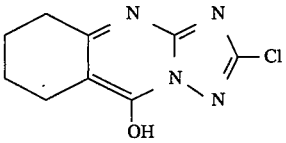

A-13

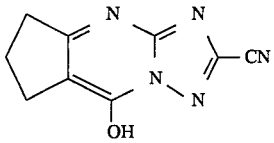

A-14

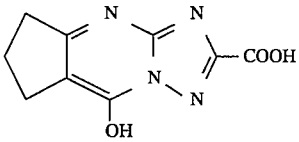

A-15

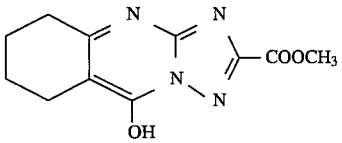

The compounds represented by formula (1) can be synthesized in accordance with the processes described in known publications, e.g., Bulow and Haas, *Berichte*, Vol. 42, p. 4638 (1907), ibid, Vol. 43, p. 375 (1910), Allen, et al., *J. Org. Chem.*, Vol. 24, p. 796 (1959), De Cat and Dormael, *Bull. Soc. Chim. Belg.*, Vol. 60, p. 69 (1951), and Cook, et al., *Rec. Trav. Chem.*, Vol. 69, p. 343 (1950).

The silver halide emulsion according to the present invention may be used either alone or as a mixture with other light-sensitive silver halide emulsions. The silver halide emulsion of the present invention and a surface and/or internally-fogged light-insensitive silver halide emulsion can be used in combination in the same layer.

Surface and/or internally-fogged silver halide grains will be explained below.

The terminology "surface and/or internally-fogged silver halide grains" (hereinafter referred to as fogged silver halide grains) as used herein means silver halide grains which are prepared by fogging by a chemical means or light to have a fog center on the surface and/or internal thereof and are therefore developable irrespective of exposure.

The silver halide grains with their surface fogged (surface-fogged silver halide grains) can be prepared by fogging silver halide grains during and/or after grain formation by a chemical means or light.

The above-mentioned fogging step can be carried out by a method of adding a reducing agent or a gold salt under appropriate pH and pAg conditions, a method of heating at a low pAg, or a method of uniformly exposing the grains to light. The reducing agent which can be used includes stannous chloride, a hydrazine type compound, ethanolamine, and thiourea dioxide.

The fogging step using these fogging substances is preferably conducted before a washing step in order to prevent the fogging substance from diffusing into light-sensitive emulsion layers and causing fogging with time.

The silver halide grains with their inside fogged (internally-fogged silver halide grains) are prepared by using the above-mentioned surface-fogged silver halide grains as a nucleus (core) and forming an outer shell on the surface of the core. The details of such inside-fogged silver halide grains are described in JP-A-59-214852. The effects of the inside-fogged silver halide grains on high speed development can be controlled by adjusting the thickness of the shell.

The internally-fogged silver halide grains can also be formed by fogging the grains right from the start of grain formation by the above-mentioned fogging method to form fogged cores and then forming an unfogged shell on each core. If desired, it is possible to fog throughout the grain from inside to surface.

The fogged silver halide grains may be any of silver chloride, silver bromide, silver chlorobromide, silver iodobromide, and silver chloroiodobromide. In case where they contain an iodide, the iodide content is preferably not more than 5 mol %, still preferably not more than 2 mol %.

The fogged silver halide grains may contain in the inside thereof an internal structure having a different halogen composition.

While these fogged silver halide grains are not particularly limited in mean grain size, it is preferable that they are smaller, in terms of mean grain size, than the silver halide grains of a light-sensitive silver halide emulsion layer to which they are added or, if they are added to a light-insensitive intermediate layer, smaller than the silver halide grains of a layer having the lowest sensitivity which is adjacent to that intermediate layer. Specifically, a preferred mean grain size is not greater than 0.5 μm, still more preferably not greater than 0.2 μm, and most preferably not greater than 0.1 μm.

The fogged silver halide grains are not particularly limited in crystal form, either regular or irregular. A poly-dispersed silver halide emulsion can be used, but a mono-dispersed silver halide emulsion is preferred.

The terminology "mono-dispersed silver halide emulsion" (non-tabular grains) as used herein means an emulsion in which at least 95% of the total weight or number of silver halide grains have a grain size falling within ±40%, preferably ±30%, of a mean grain size.

The amount of the fogged silver halide grains to be used is subject to variation depending on the demand in the present invention. It is preferably from 0.05 to 50 mol %, still more preferably from 0.1 to 25 mol %, and most preferably from 0.5 to 20 mol %, in terms of silver content based on the silver content of the emulsion according to the present invention.

The silver halide emulsion of the present invention and colloidal silver can be used in combination in the same layer. Colloidal silver to be used in the present invention may have any color, e.g., yellow, brown, blue, black, etc.

The amount of colloidal silver to be used is subject to variation depending on the demand in the present invention. It is preferably from 0.05 to 50 mol %, still more preferably from 0.1 to 25 mol %, and most preferably from 0.5 to 20 mol %, in terms of silver content based on the silver content in the emulsion according to the present invention.

Methods of preparing various types of colloidal silver are described in the literature, for example, Weiser, *Colloidal Elements*, Wiley & Sons, New York (1933) (yellow colloidal silver prepared by Carey Lea's dextrin reduction), German Patent 1096193 (brown and black colloidal silver), and U.S. Pat. No. 2,688,601 (blue colloidal silver).

As described above, the emulsion comprising the emulsion grains according to the present invention may be used either alone or as a mixture with other light-sensitive silver halide emulsions, a surface and/or internally-fogged silver halide emulsion, or colloidal silver. The emulsion of the present invention may contain the compound of formula (1). The emulsion may also be used in combination with both the compound of formula (1) and the above-mentioned other emulsions, etc.

Where the emulsion of the present invention is mixed with other silver halide emulsions, the former is preferably used in a proportion of at least 20%, still more preferably at least 50%, and most preferably at least 70%.

The photographic emulsion of the present invention is applicable to various color and black-and-white light-sensitive materials, typically including color negative films for general use or for movies, color reversal films for slides or TV cameras, color paper, color positive films, color reversal paper, color diffusion light-sensitive materials, and heat-developable color light-sensitive materials.

The photographic emulsion of the present invention is also applicable to films for photomechanical process, such as lith films and scanner films, medical X-ray films for direct or indirect photographing, industrial X-ray films, negative black-and-white films for photographing, black-and-white photographic paper, computer output microfilms (COM), general microfilms, silver salt diffusion transfer light-sensitive materials, and print-out light-sensitive materials.

Color light-sensitive materials to which the photographic emulsion of the present invention is applied comprise a support having thereon at least one of blue-sensitive, green-sensitive, red-sensitive, and infrared-sensitive silver halide emulsion layers. The number and order of silver halide emulsion layers and light-insensitive layers are not particularly limited. A typical material comprises a support having thereon at least one light-sensitive layer composed of a plurality of silver halide emulsion layers which have substantially the same color-sensitivity but are different in sensitivity (hereinafter referred to as a light-sensitive layer unit). In this structure, the light-sensitive layer above referred to is a light-sensitive layer unit having sensitivity to any of blue light, green light and red light. In a multilayer silver halide color photographic material, light-sensitive layer units are generally provided on a support in the order of a red-sensitive layer unit, a green-sensitive layer unit, and a blue-sensitive layer unit from the support side. Depending on the end use, the above order of layers may be reversed, or two layers having the same color sensitivity may have therebetween a layer having different color sensitivity.

A light-insensitive layer may be provided as an intermediate layer between the above-described silver halide light-sensitive layers, an uppermost layer or an undermost layer.

The intermediate layer may contain couplers or DIR compounds as described in JP-A-61-43748, JP-A-59-113438, JP-A-59-113440, JP-A-61-20037, and JP-A-61-20038 and may also contain color mixing inhibitors as usual.

A plurality of silver halide emulsion layers constituting each light-sensitive layer unit preferably have a two-layer structure composed of a high sensitivity emulsion layer and a low sensitivity emulsion layer as described in West German Patent 1,121,470 and British Patent 923,045. The two layers are generally provided in an order of descending photosensitivity toward the support. Between the two silver halide emulsion layers, a light-insensitive layer may be provided. It is also possible to provide a low sensitivity emulsion layer on the side farther from the support, and a high sensitivity emulsion layer on the side closer to the support, as described in JP-A-57-112751, JP-A-62-00350, JP-A-62-206541, and JP-A-62-206543.

Examples of layer orders include an order of low sensitive blue-sensitive layer (BL)/high sensitive blue-sensitive layer (BH)/high sensitive green-sensitive layer (GH)/low sensitive green-sensitive layer (GL)/high sensitive red-sensitive layer (RH)/low sensitive red-sensitive layer (RL), an order of BH/BL/GL/GH/RH/RL, and an order of BH/BL/GH/GL/RL/RH, each from the side farthest from the support.

A layer order of blue-sensitive layer/GH/RH/GL/RL from the side farthest from the support as described in JP-B-55-34932 and a layer order of blue-sensitive layer/GL/RL/GH/RH from the side farthest from the support as described in JP-A-56-25738 and JP-A-62-63936 are also employable.

Further, a light-sensitive unit may be composed of three layers whose photosensitivity differs in a descending order toward the support, i.e., the most sensitive silver halide emulsion layer as the upper layer, a middle sensitive silver halide emulsion layer as an intermediate layer, and the least sensitive silver halide emulsion layer as the lower layer, as proposed in JP-B-49-15495. Three layers of different sensitivity in each unit may be arranged in the order of middle sensitive emulsion layer/high sensitive emulsion layer/low sensitive emulsion layer from the side farther from a support as described in JP-A-59-202464.

Furthermore, an order of high sensitive emulsion layer/low sensitive emulsion layer/middle sensitive emulsion layer or an order of low sensitive emulsion layer/middle sensitive emulsion layer/high sensitive emulsion layer are also employable.

Where the silver halide emulsion of the present invention is used in the above-described multilayer light-sensitive materials, various silver halide emulsions can be used in combination with the emulsions of the present invention. It is preferable to arrange a tabular silver halide emulsion as a layer farther from the support in a unit of one color sensitivity.

In order to improve color reproducibility, it is preferable that an interimage effect-donating layer (CL) which has a different spectral sensitivity distribution from a main light-sensitive layer (e.g., BL, GL, or RL) be provided next to, or close to the main light-sensitive layer, as described in U.S. Pat. Nos. 4,663,271, 4,705,744, and 4,707,436 and JP-A-62-160448 and JP-A-63-89580.

Known additives which can be used in combination with the photographic emulsion of the present invention are described in two volumes of *Research Disclosure* as tabulated below.

| Additive | RD 17643 | RD 18716 |
|---|---|---|
| 1. Chemical Sensitizer | p. 23 | p. 648, right column (RC) |
| 2. Sensitivity Increasing Agent | | p. 648, right column (RC) |
| 3. Spectral Sensitizer, Supersensitizer | pp. 23–24 | p. 648, RC to p. 649, RC |
| 4. Brightening Agent | p. 24 | |
| 5. Antifoggant and Stabilizer | pp. 24–25 | p. 649, RC |
| 6. Light Absorbent, Filter Dye, Ultrasonic Absorbent | pp. 25–26 | p. 649, RC to p. 650, left column (LC) |
| 7. Stain Inhibitor | p. 25, RC | p. 650, LC to RC |
| 8. Dye Image Stabilizer | p. 25 | |
| 9. Hardening Agent | p. 26 | p. 651, LC |
| 10. Binder | p. 26 | p. 651, LC |
| 11. Plasticizer, Lubricant | p. 27 | P. 650, RC |
| 12. Coating Aid, Surface Active Agent | pp. 26–27 | P. 650, RC |
| 13. Antistatic Agent | p. 27 | P. 650, RC |

In order to prevent deterioration in photographic performance due to formaldehyde gas, a compound capable of reacting with formaldehyde to fix it as described in U.S. Pat. Nos. 4,411,987 and 4,435,503 is preferably added to light-sensitive materials.

The photographic emulsion according to the present invention is preferably used in color light-sensitive materials. Various couplers can be used in color light-sensitive materials. Specific examples of useful couplers are described in patents cited in *Research Disclosure* (RD), No. 17643, supra, VII-C to G.

Examples of suitable yellow couplers are described, e.g., in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP-A-249,473.

Examples of suitable magenta couplers include 5-pyrazolone couplers and pyrazoloazole couplers. Examples of particularly preferred magenta couplers are described in U.S. Pat. Nos. 4,310,619 and 4,351,897, European Patent 73,636, U.S. Pat. Nos. 3,061,432 and 3,725,064, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO 88/04795.

Cyan couplers include phenol couplers and naphthol couplers. Examples of suitable couplers are described in U.S. Pat. Nos 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, EP-A-121,365, EP-A-249,453, U.S. Pat. Nos 3,446,622, 4,333,999, 4,775,616, 4,451,559, 4,427,767, 4,690,889, 4,254,212, and 4,296,199, and JP-A-61-42658.

Suitable colored couplers which can be used for correcting unnecessary absorption of a developed dye are described in *Research Disclosure*, No. 17643, VII-G, U.S. Pat. No. 4,163,670, JP-B-57-39413, U.S. Pat. Nos. 4,004,929 and 4,138,258 and British Patent 1,146,368. Further, couplers capable of releasing a fluorescent dye upon coupling with which unnecessary absorption of a developed dye is corrected as described in U.S. Pat. No. 4,774,181 and couplers having a dye precursor group as a releasable group which is capable of reacting with a developing agent to form a dye as described in U.S. Pat. No. 4,777,120 are preferably used.

Examples of suitable couplers which develop a dye having moderate diffusibility are described in U.S. Pat. No. 4,366,237, British Patent 2,125,570, European Patent 96,570, and West German Patent (OLS) No. 3,234,533.

Typical examples of polymerized dye-forming couplers are described in U.S. Pat. Nos. 3,451,820, 4,080,211, 4,367,288, 4,409,320, and 4,576,910, and British Patent 2,102,173.

Couplers capable of releasing a photographically useful residue on coupling are also used to advantage. Examples of suitable DIR couplers capable of releasing a development inhibitor are described in patents cited in RD, No. 17643, VII-F, JP-A-57-151944, JP-A-57-154234, JP-A-60-184248, JP-A-63-37346, JP-A-63-37350, and U.S. Pat. Nos. 4,248,962 and 4,782,012.

Additional examples of couplers which can be used in the light-sensitive material of the present invention include competing couplers described in U.S. Pat. No. 4,130,427; polyequivalent couplers as described in U.S. Pat. Nos. 4,283,472, 4,338,393, and 4,310,618; couplers capable of releasing a DIR redox compound, couplers capable of releasing a DIR coupler, redox compounds capable of releasing a DIR coupler, or redox compounds capable of releasing a DIR redox compound as described in JP-A-60-185950 and JP-A-62-24252; couplers capable of releasing a dye which restores its color after release as described in EP-A-173,302 and EP-A-313,308; couplers capable of releasing a bleaching accelerator as described in R.D. No. 11449, R.D. No. 24241, and JP-A-61-201247; couplers capable of releasing a ligand described in U.S. Pat. No. 4,553,477; couplers capable of releasing a leuco dye described in JP-A-63-75747; and couplers capable of releasing a fluorescent dye described in U.S. Pat. No. 4,774,181.

The color light-sensitive materials of the present invention preferably contain various antiseptics or antifungal agents, such as 1,2-benzisothiazolin-3-one, n-butyl p-hydroxybenzoate, phenol, 4-chloro-3,5-dimethylphenol, 2-phenoxyethanol, 2-(4-thiazolyl)benzimidazole, etc. as described in JP-A-63-257747, JP-A-62-272248, and JP-A-1-80941.

Examples of supports which can be suitably used in the present invention are described, e.g., in *RD*, No. 17632, p. 28, and ibid., No. 18716, p. 647, right column to p. 648, left column.

In the light-sensitive materials using the photographic emulsion of the present invention, the hydrophilic colloidal layers on the side having emulsion layers preferably have a total film thickness of not more than 28 μm, still more preferably not more than 23 μm, most preferably not more than 20 μm; and a rate of swelling $T_{1/2}$ of not more than 30 seconds, still preferably not more than 20 seconds. The terminology "film thickness" as used herein means a film thickness as measured after conditioning at 25° C. and a relative humidity of 55% for 2 days. A rate of swelling $T_{1/2}$ can be measured by the method known in the art with a swellometer of the type described, e.g., in A. Green, et al., *Photographic Science and Engineering*, Vol. 19, No. 2, pp. 124–129. –$T_{1/2}$" is defined as a time required for a photographic material to be swollen to ½ the saturated swollen thickness, the saturated swollen thickness being defined to be 90% of the maximum swollen thickness which is reached when the material is swollen with a color developing solution at 30° C. for 3 minutes and 15 seconds.

The rate of swelling $T_{1/2}$ can be controlled by adding a hardening agent for a gelatin binder or by varying aging conditions after coating. Further, the light-sensitive material preferably has a degree of swelling of from 150 to 400%. The "degree of swelling" can be calculated from the maximum swollen film thickness as defined above according to formula: (maximum swollen film thickness—film thickness)/film thickness.

The color light-sensitive material according to the present invention may use a support comprising a heat-treated poly(alkylene aromatic dicarboxylate) polymer described in U.S. Pat. No. 4,141,735.

The color light-sensitive materials according to the present invention can be development processed according to usual methods as described in *RD* No. 17643, pp. 28–29 and *RD* No. 18716, p. 615, left to right columns.

In case of carrying out reversal processing, color development is generally preceded by black-and-white development. A black-and-white developing solution to be used contains one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

After desilvering, the silver halide color light-sensitive materials using the photographic emulsion of the present invention are generally subjected to washing and/or stabilization. The amount of washing water to be used in the washing step is selected from a broad range depending on characteristics of the light-sensitive material (e.g., the kind of photographic materials such as couplers), the end use of the light-sensitive material, the temperature of washing water, the number of washing tanks (the number of stages), the replenishing system (e.g., counter-flow system or co-current system), and other various conditions. For example, a relation between the number of washing tanks and the quantity of water in a multi-stage counter-flow system can be obtained by the method described in *Journal of the Society of Motion Picture and Television Engineers*, Vol. 64, pp. 248–253 (May, 1955).

According to the disclosed multi-stage counter-flow system, a requisite amount of water can be greatly reduced. On the other hand, bacteria tend to grow in the tank with an increase in water retention time, and suspended bacterial cells adhere to light-sensitive materials. Such a problem can be effectively solved by adopting a method of reducing calcium and magnesium ions of washing water as described in JP-A-62-288838. It is also effective to use bactericides, such as isothiazolone compounds or thiabendazole compounds as described in JP-A-57-8542; chlorine type bactericides, e.g., chlorinated sodium isocyanurate; benzotriazole; and other bactericides described in Horiguchi Hiroshi, *Bokin bobaizai no kagaku*, Sankyo Shuppan (1986), Eisei Gijutsukai (ed.), *Biseibutsu no mekkin, sakkin, bobai gijutsu* Kogyo Gijutsukai (1982), and Nippon Bokin Bobai Gakkai (ed.), *Bokin bobaizai jiten* (1986).

Washing water has a pH usually between 4 and 9, and preferably between 5 and 8. Water temperature and washing time, though varying depending on the characteristics or the end use of the light-sensitive material and the like, are usually from 15° to 45° C. in temperature and from 20 seconds to 10 minutes in time, and preferably from 25° to 40° C. and from 30 seconds to 5 minutes.

The washing step may be replaced with direct processing using a stabilizer. Any of known techniques described in JP-A-57-8543, JP-A-58-14834, and JP-A-60-220345 can be used in such a stabilization step.

In some cases, the washing step may be followed by stabilization. In these cases, a formalin bath, which is used as a final bath for color light-sensitive materials for photographing, may be used.

The present invention will be explained in greater detail with reference to Examples, but it should be understood that the present invention is not construed as being limited thereto.

EXAMPLE 1

(1) Preparation of Emulsions:

a. Preparation of Em-1:

To an aqueous solution of 0.9 g of potassium bromide, 50 g of inert gelatin, and 4.5 g of ammonium nitrate in 1 l of distilled water, 17.4 cc of 1N sodium hydroxide was added while stirring well. A 4% aqueous solution of potassium bromide and a 4% aqueous solution of silver nitrate were added thereto over 9 minutes according to a double jet process. During the addition, the temperature and pAg were maintained at 72° C. and 7.1, respectively. The first step is defined as addition (1), in which 10% of the total amount of silver was consumed). A 20% aqueous solution of potassium bromide containing potassium iodide in such an amount that 4.1 g of potassium iodide might be added and a 20% aqueous solution of silver nitrate were then added at a temperature kept at 72° C. and a pAg kept at 6.9 over a period of 37 minutes according to a double jet process. (The second step is defined as addition (2), in which 70% of the total silver was consumed). Further, a 20% aqueous solution of potassium bromide and a 20% aqueous solution of silver nitrate were added at a temperature kept at 72° C. and a pAg kept at 7.4 over 10 minutes according to a double jet process. (The third step is defined as addition (3), in which 20.0% of the total silver content was consumed). The resulting emulsion was washed by a known flocculation method at 35° C., gelatin added thereto, the system heated to 60° C., and the emulsion was chemically sensitized to the optimum degree by using sodium benzenethiosulfonate, sodium thiosulfate, sodium thiocyanate, dimethylselenourea, and chloroauric acid. After completion of the chemical sensitization, 0.20 g of compound F-3 was added, and 16 cc of a 1% aqueous KI solution was then added to form a high silver iodide portion on the surface of emulsion grains. Thereafter, sensitizing dyes S-1, S-2, S-3, and S-4 were added in the respective optimal amount to obtain a comparative emulsion Em-1 comprising cubic AgBrI grains (AgI content: 3.6 mol %) having a mean grain diameter of 0.40 μm.

b. Preparation of Em-2:

An emulsion Em-2 comprising cubic AgBrI grains (AgI content: 3.6 mol %) having a mean grain diameter of 0.40 μm was prepared in the same manner as described above for Em-1, except that the amount of potassium iodide added in addition (2) was changed to 3.1 g and 1.0 g of potassium iodide was added between addition (2) and addition (3) as a 1.5% aqueous potassium iodide solution at a constant rate over a period of 2 minutes.

c. Preparation of Em-3:

A comparative emulsion Em-3 comprising cubic AgBrI grains (AgI content: 3.6 mol %) having a mean grain diameter of 0.40 μm was prepared in the same manner as for Em-1, except that, after addition (1), a 20% aqueous potassium bromide solution and a 20% aqueous silver nitrate solution were added at a temperature kept at 72° C. and a pAg kept at 6.9 over a period of 37 minutes according to a double jet process (by this addition (2), 70% of the total silver was consumed) and subsequently 4.1 g of potassium iodide was added as a 1.5% aqueous solution at a constant rate over a period of 7 minutes.

d. Preparation of Em-4:

To an aqueous solution of 0.9 g of potassium bromide, 50 g of inert gelatin, and 4.5 g of ammonium nitrate in 1 l of distilled water, 15.0 cc of 1N sodium hydroxide was added while stirring well. A 4% aqueous solution of potassium bromide and a 4% aqueous solution of silver nitrate were added thereto over 18 minutes according to a double jet process. During the addition, the temperature and pAg were maintained at 72° C. and 7.1, respectively. By this addition (1), 10% of the total silver was consumed. Subsequently, a 20% aqueous solution of potassium bromide containing potassium iodide in such an amount that 4.1 g of potassium iodide might be added and a 20% aqueous solution of silver nitrate were added at a temperature kept at 72° C. and a pAg kept at 7.2 over a period of 37 minutes according to a double jet process. By this addition (2), 70% of the total silver was consumed. Further, a 20% aqueous solution of potassium bromide and a 20% aqueous solution of silver nitrate were added at a temperature kept at 72° C. and a pAg kept at 8.0 over 10 minutes according to a double jet process. By this addition (3), 20.0% of the total silver content was consumed. The resulting emulsion was washed by a known flocculation method at 35° C., gelatin added thereto, the system heated to 60° C., and the emulsion was chemically sensitized to the optimum degree by using sodium benzenethiosulfonate, sodium thiosulfate, sodium thiocyanate, dimethylselenourea, and chloroauric acid. After completion of the chemical sensitization, 0.15 g of compound F-3 was added, and 32.0 cc of a 1% aqueous KI solution was then added thereto to form a high silver iodide content portion on the surface of emulsion grains. Thereafter, sensitizing dyes S-1, S-2, S-3, and S-4 were added in the respective optimal amount to obtain a comparative emulsion Em-4 comprising tetradecahedral AgBrI grains having a mean grain diameter of 0.50 μm (AgI content: 3.7 mol %).

e. Preparation of Em-5:

An emulsion Em-5 comprising tetradecahedral AgBrI grains (AgI content: 3.7 mol %) having a mean grain diameter of 0.50 μm was prepared in the same manner as for emulsion Em-4, except for changing the amount of potassium iodide to be added by addition (2) to 2.8 g, suspending addition (3) at the point when 10% of the total silver had been added, then adding 1.3 g of potassium iodide as a 1.5% aqueous potassium iodide solution at a constant rate over 2 minutes, and resuming addition (3).

f. Preparation of Emulsion Em-6:

An emulsion Em-6 comprising tetradecahedral AgBrI grains (AgI content: 3.7 mol %) having a mean grain diameter of 0.50 μm was prepared in the same manner as for emulsion Em-4, except that, after addition (1), a 20% aqueous potassium bromide solution and a 20% aqueous silver nitrate solution were added at a temperature kept at 72° C. and a pAg kept at 7.2 over 37 minutes (by this addition (2), 70% of the total silver was consumed), addition (3) was ceased at the point when 10% of the total silver had been added, then 4.1 g of potassium iodide was added as a 1.5% aqueous solution at a constant rate over 7 minutes, and addition (3) was resumed. g. Preparation of Emulsion Em-7:

To an aqueous solution of 0.9 g of potassium bromide, 50 g of inert gelatin, and 4.0 g of ammonium nitrate in 1 l of distilled water, 12.0 cc of 1N sodium hydroxide was added while stirring well. A 4% aqueous solution of potassium bromide and a 4% aqueous solution of silver nitrate were added thereto over 5 minutes according to a double jet process. During the addition, the temperature and pAg were maintained at 72° C. and 7.1, respectively. By this addition (1), 10% of the total amount of silver was consumed. Subsequently, a 20% aqueous solution of potassium bromide containing potassium iodide in such an amount that 4.1 g of potassium iodide might be added and a 20% aqueous solution of silver nitrate were added at a temperature kept at 72° C. and a pAg kept at 8.3 over a period of 37 minutes according to a double jet process. By this addition (2), 70% of the total silver was consumed. Further, a 20% aqueous solution of potassium bromide and a 20% aqueous solution of silver nitrate were added thereto at a temperature kept at 72° C. and a pAg kept at 8.5 over 10 minutes according to a double jet process. By this addition (3), 20.0% of the total silver content was consumed. The resulting emulsion was ripened with sodium thiocyanate at 50° C. for 20 minutes and washed by a known flocculation method at 35° C., gelatin added, the system heated to 60° C., and chemical sensitization was conducted optimally by using sodium benzenethiosulfonate, sodium thiosulfate, sodium thiocyanate, dimethylselenourea, and chloroauric acid. After completion of the chemical sensitization, 0.25 g of compound F-3 was added, and 25.0 cc of a 1% aqueous KI solution was then added thereto to form a high silver iodide portion on the surface of emulsion grains. Thereafter, sensitizing dyes S-1, S-2, S-3, and S-4 were added in the respective optimal amount to obtain a comparative emulsion Em-7 comprising octahedral AgBrI grains (AgI content: 3.7 mol %) having a mean grain diameter of 0.30 μm. The grains had a curvature radius of 1/7 r at the corners as measured by the method described in JP-A-58-107530 which corresponds to EP 96727 A1 and WO 83/02338.

g. Preparation of Emulsion Em-8:

An emulsion Em-9 comprising octahedral AgBrI grains (AgI content: 3.7 mol %) having a mean grain diameter of 0.30 μm was prepared in the same manner as for Em-7, except for changing the amount of potassium iodide to be added in addition (2) to 2.8 g, ceasing addition (2) at the point when 50% of the total silver had been added, then adding 1.3 g of potassium iodide as a 1.2% aqueous solution at a constant rate over 2 minutes, and again continuing addition (2).

h. Preparation of Emulsion Em-9:

A comparative emulsion Em-9 comprising octahedral AgBrI grains (AgI content: 3.7 mol %) having a mean grain diameter of 0.30 μm was prepared in the same manner as for Em-7, except that, after addition (1), a 20% aqueous potassium bromide solution and a 20% aqueous silver nitrate solution were added at a temperature kept at 72° C. and a pAg kept at 8.3 according to a double jet process until 50% of the total silver was added, and then 4.1 g of potassium iodide was added as a 1.2% aqueous solution at a constant rate over 7 minutes, followed by resuming addition (2). By this adding (2), 70% of the total silver was consumed.

i. Preparation of Emulsion Em-10:

To an aqueous solution of 12 g of potassium bromide and 25 g of inert gelatin in 4 l of distilled water, 14% aqueous solution of potassium bromide and a 20% aqueous solution of silver nitrate were added over 1 minute according to a double jet process. During the addition, the temperature was maintained at 50° C. By this addition (1), 10% of the total silver was consumed. Thereafter, 300 cc of a 17% aqueous gelatin solution was added thereto. After raising the temperature to 75° C., 40 cc of a 25% aqueous solution of ammonium nitrate and 75 cc of 1N sodium hydroxide were added. After 15 minutes, 500 cc of 1N $H_2SO_4$ was added.

Subsequently, a 20% aqueous potassium bromide solution containing potassium iodide in such an amount that 2.0 g of potassium iodide might be added and a 20% aqueous solution of silver nitrate were further added at a temperature kept at 75° C. and a pAg kept at 8.4 according to a double jet process. By this addition (2), 70% of the total silver was consumed. The temperature was lowered to 45° C., potassium bromide was added to adjust the pAg to 9.3, and 0.4 g of potassium iodide was added as a 1.2% aqueous solution at a constant rate over 2 minutes. Then, a 20% aqueous solution of potassium bromide and a 20% aqueous solution of silver nitrate were added thereto at a pAg kept at 8.4 over 10 minutes according to a double jet process. By this addition (3), 20.0% of the total silver content was consumed. The resulting emulsion was washed by a known flocculation method at 35° C., gelatin was added thereto, the system was heated to 60° C., and the emulsion was chemically sensitized to the optimum degree by using sodium benzenethiosulfonate, sodium thiosulfate, sodium thiocyanate, dimethylselenourea, and chloroauric acid. After completion of the chemical sensitization, 0.25 g of compound F-3 was added, and 25.0 cc of a 1% aqueous KI solution was then added thereto to form a high silver iodide portion on the surface of emulsion grains. Thereafter, sensitizing dyes S-1, S-2, S-3, and S-4 were added in the respective optimal amount to obtain a comparative emulsion Em-10 comprising tabular AgBrI grains (AgI content: 2.0 mol %) having a mean grain diameter of 0.70 μm according to the present invention.

j. Preparation of Emulsion Em-11:

A comparative emulsion Em-11 comprising tabular AgBrI (AgI content: 2.0 mol %) having a mean grain size of 0.70 μm was prepared in the same manner as for Em-10, except that potassium iodide was not added in the addition (2) and that the amount of KI to be added in the subsequent addition of potassium iodide alone was changed to 2.4 g.

k. Preparation of Emulsion Em-12:

To an aqueous solution of 11 g of potassium bromide and 27 g of inert gelatin in 3.5 l of distilled water, 14% aqueous solution of potassium bromide and a 20% aqueous solution of silver nitrate were added over 2 minutes according to a double jet process. During the addition, the temperature was maintained at 35° C. By this addition (1), 10% of the total silver content was consumed. Thereafter, 300 cc of a 17% aqueous gelatin solution was added thereto. After raising the temperature to 75° C., 40 cc of a 25% aqueous solution of ammonium nitrate and 75 cc of 1N sodium hydroxide were added. After 15 minutes, 500 cc of 1N $H_2SO_4$ was added. Subsequently, a 20% potassium bromide aqueous solution containing potassium iodide in such an amount that 4.0 g of potassium iodide might be added and a 20% aqueous solution of silver nitrate were added at a temperature kept at 75° C. and a pAg kept at 8.4 according to a double jet process. By this addition (2), 50% of the total silver was consumed. The temperature was lowered to 50° C., potassium bromide was added to adjust the pAg to 9.3, and a 20% aqueous solution of potassium bromide and a 20% aqueous solution of silver nitrate were added thereto at a pAg kept at 8.4 over 5 minutes according to a double jet process. By this stage of addition (3), 10.0% of the total silver content was consumed. Thereafter, 0.8 g of potassium iodide was added thereto as a 1.2% aqueous solution at a constant rate over 2 minutes, and the addition (3) was further continued over an additional period of 10 minutes. By this addition (4), 30.0% of the total silver was consumed. The resulting emulsion was washed by a known flocculation method at 35° C., gelatin was added thereto, followed by heating to 60° C., and the emulsion was chemically sensitized to the optimum degree by using sodium benzenethiosulfonate, sodium thiosulfate, sodium thiocyanate, dimethylselenourea, and chloroauric acid. After completion of the chemical sensitization, 0.25 g of compound F-3 was added, and 25.0 cc of a 1% aqueous KI solution was then added thereto to form a high silver iodide portion on the surface of emulsion grains. Thereafter, sensitizing dyes S-11 and S-12 were added in the respective optimal amount to obtain an emulsion Em-12 comprising tabular AgBrI grains (AgI content: 4.0 mol %) having a mean grain diameter of 0.55 μm according to the present invention.

l. Preparation of Emulsion Em-13:

A comparative emulsion Em-13 comprising tabular AgBrI (AgI content: 4.0 mol %) having a mean grain size of 0.55 μm was prepared in the same manner as for Em-12, except that potassium iodide was not added in the addition (2) and that the amount of KI to be added in the subsequent addition of potassium iodide alone was changed to 4.8 g.

m. Preparation of Emulsion Em-20:

To an aqueous solution of 0.9 g of potassium bromide, 50 g of inert gelatin, and 4.5 g of ammonium nitrate in 1 l of distilled water, 17.4 cc of 1N sodium hydroxide was added while stirring well. A 4% aqueous solution of potassium bromide and a 4% aqueous solution of silver nitrate were added thereto over 7 minutes according to a double jet process. During the addition, the temperature and pAg were maintained at 72° C. and 7.1, respectively. By this addition (1), 10% of the total amount of silver was consumed. Subsequently, a 20% aqueous potassium bromide solution containing potassium iodide in such an amount that 3.8 g of potassium iodide might be added and a 20% aqueous solution of silver nitrate were added at a temperature kept at 72° C. and a pAg kept at 6.9 over 37 minutes according to a double jet process. By this addition (2), 70% of the total silver was consumed. Then, 0.5 g of potassium iodide was added as a 1.2% aqueous solution at a constant rate over 2 minutes, and a 20% aqueous solution of potassium bromide and a 20% aqueous solution of silver nitrate were added at a temperature kept at 72° C. and a pAg kept at 7.4 over 10 minutes according to a double jet process. By this addition (3), 20.0% of the total silver content was consumed. The resulting emulsion was washed by a known flocculation method at 35° C., gelatin was added thereto, followed by heating to 60° C., and the emulsion was chemically sensitized to the optimum degree by using sodium benzenethiosulfonate, sodium thiosulfate, sodium thiocyanate, dimethylselenourea, and chloroauric acid. After completion of the chemical sensitization, 0.17 g of compound F-3 was added, and 12.0 cc of a 1% aqueous KI solution was then added thereto to form a high silver iodide portion on the surface of emulsion grains. Thereafter, sensitizing dyes S-5, S-6, S-7, S-8, S-9, and S-10 were added in the respective optimal amount to obtain an emulsion Em-20 comprising cubic AgBrI grains (AgI content: 3.7 mol %) having a mean grain diameter of 0.45 μm according to the present invention.

n. Preparation of Emulsions Em-21 to 37:

Emulsions Em-21 to 37 were prepared in the same manner as for Em-20, except for varying the iodide distribution structure, iodide content, and surface silver iodide content.

o. Preparation of Emulsions Em-40 to 43:

Emulsions Em-40 to 43 were prepared in the same manner as Em-20, except for varying the surface silver iodide content and the kinds of chemical sensitizers.

The grain structure of Em-1 to 13, that of Em-20 to 37, and that of Em-40 to 43 are shown in Tables 1 through 3, respectively.

TABLE 1

| Emulsion No. | Grain Shape | AgI Content (mol %) (Ratio of Ag to Total Ag (%)) Total | Internal Nucleus | First Coat | Second Coat | Inner Conversion Phase | Outer Conversion Phase | Position of Inner Iodide Conversion Phase | Coefficient of Variation (%) |
|---|---|---|---|---|---|---|---|---|---|
| Em-1 (Comparison) | cubic | 3.6 | 0 (10) | 5.0 (70) | 0 (19.9) | — | 100 (0.1) | none | 8 |
| Em-2 (Invention) | cubic | 3.6 | 0 (10) | 3.8 (69.1) | 0 (19.9) | 100 (0.9) | 100 (0.1) | 80% of grain formation | 8 |
| Em-3 (Comparison) | cubic | 3.6 | 0 (76.5) | 0.0 (19.9) | — | 100 (3.5) | 100 (0.1) | 80% of grain formation | 8 |
| Em-4 (Comparison) | 14-hedral | 3.7 | 0 (10) | 5.0 (70) | 0 (19.8) | — | 100 (0.2) | none | 9 |
| Em-5 (Invention) | 14-hedral | 3.7 | 0 (10) | 3.5 (68.9) | 0 (19.8) | 100 (1.1) | 100 (0.2) | 90% of grain formation | 9 |
| Em-6 (Comparison) | 14-hedral | 3.7 | 0 (76.5) | 0.0 (19.8) | — | 100 (3.5) | 100 (0.2) | 90% of grain formation | 9 |
| Em-7 (Comparison) | 8-hedral | 3.7 | 0 (10) | 5.0 (70) | 0 (19.8) | — | 100 (0.2) | none | 10 |
| Em-8 (Invention) | 8-hedral | 3.7 | 0 (10) | 3.4 (68.9) | 0 (19.8) | 100 (1.1) | 100 (0.2) | 60% of grain formation | 10 |
| Em-9 (Comparison) | 8-hedral | 3.7 | 0 (76.5) | 0.0 (19.8) | — | 100 (3.5) | 100 (0.2) | 60% of grain formation | 10 |
| Em-10 (Invention) | tabular | 2.0 | 0 (10) | 2.1 (69.7) | 0 (19.8) | 100 (0.3) | 100 (0.2) | 80% of grain formation | 15 |
| Em-11 (Comparison) | tabular | 2.0 | 0 (78.2) | 0.0 (19.8) | — | 100 (1.8) | 100 (0.2) | 80% of grain formation | 15 |
| Em-12 (Invention) | tabular | 4.0 | 0 (10) | 6.3 (49.4) | 0 (38.2) | 100 (0.6) | 100 (0.2) | 70% of grain formation | 10 |
| Em-13 (Comparison) | tabular | 4.0 | 0 (56.2) | 0 (38.8) | — | 100 (3.8) | 100 (0.2) | 70% of grain formation | 10 |

Note: Em-7 to 9 comprised grains having rounded apexes.

TABLE 2

| Emulsion No. | AgI Content (mol %) (Ratio of Ag to Total Ag (%)) Total | Internal Nucleus | First Coat | Second Coat | Inner Conversion Phase | Outer Conversion Phase | Position of Inner Iodide Conversion Phase | Coefficient of Variation (%) |
|---|---|---|---|---|---|---|---|---|
| Em-20 (Invention) | 3.7 | 0 (10) | 4.6 (69.5) | 0 (20) | 100 (0.4) | 100 (0.1) | 70% of grain formation | 9 |
| Em-21 (Invention) | 4.5 | 0 (10) | 5.6 (69.4) | 0 (20) | 100 (0.5) | 100 (0.1) | 70% of grain formation | 9 |
| Em-22 (Invention) | 6.0 | 0 (10) | 7.4 (69.1) | 0 (20) | 100 (0.8) | 100 (0.1) | 70% of grain formation | 9 |
| Em-23 (Invention) | 2.0 | 0 (10) | 2.4 (69.7) | 0 (20) | 100 (0.2) | 100 (0.1) | 70% of grain formation | 9 |
| Em-24 (Invention) | 3.7 | 0.5 (10) | 4.5 (69.5) | 0 (20) | 100 (0.4) | 100 (0.1) | 70% of grain formation | 13 |
| Em-25 (Comparison) | 3.7 | 2 (10) | 4.2 (69.4) | 0 (20) | 100 (0.5) | 100 (0.1) | 70% of grain formation | 20 |
| Em-26 (Comparison) | 3.7 | 0 (10) | 0.0 (66.3) | 0 (20) | 100 (3.6) | 100 (0.1) | 70% of grain formation | 9 |
| Em-27 (Invention) | 3.7 | 0 (17) | 5.0 (62.4) | 0 (20) | 100 (0.5) | 100 (0.1) | 70% of grain formation | 9 |
| Em-28 (Invention) | 3.7 | 0 (47.5) | 10.0 (32.0) | 0 (20) | 100 (0.4) | 100 (0.1) | 70% of grain formation | 9 |
| Em-29 (Invention) | 3.7 | 0 (63.5) | 20.0 (16.0) | 0 (20) | 100 (0.4) | 100 (0.1) | 70% of grain formation | 9 |
| Em-30 (Comparison) | 3.7 | 0 (71.5) | 40.0 (8.0) | 0 (20) | 100 (0.4) | 100 (0.1) | 70% of grain formation | 9 |
| Em-31 (Invention) | 3.7 | 0 (10) | 3.8 (68.9) | 0 (20) | 100 (1.0) | 100 (0.1) | 70% of grain formation | 9 |
| Em-32 (Invention) | 3.7 | 0 (10) | 2.4 (67.9) | 0 (20) | 100 (2.0) | 100 (0.1) | 70% of grain formation | 9 |
| Em-33 (Invention) | 3.7 | 0 (10) | 4.6 (69.5) | 0 (20) | 100 (0.4) | 100 (0.1) | 70% of grain formation | 9 |
| Em-34 (Invention) | 3.7 | 0 (16.5) | 4.6 (63.0) | 1.5 (20) | 100 (0.4) | 100 (0.1) | 70% of grain formation | 9 |
| Em-35 (Invention) | 3.7 | 0 (23) | 4.6 (56.5) | 3.0 (20) | 100 (0.4) | 100 (0.1) | 70% of grain formation | 9 |
| Em-36 (Comparison) | 3.7 | 0 (29.5) | 4.6 (50) | 4.5 (20) | 100 (0.4) | 100 (0.1) | 70% of grain formation | 9 |
| Em-37 | 3.7 | 0 (seed) | 4.6 | 0 | 100 | 100 | 70% of grain | 6 |

TABLE 2-continued

| Emulsion No. | AgI Content (mol %) (Ratio of Ag to Total Ag (%)) Total | Internal Nucleus | First Coat | Second Coat | Inner Conversion Phase | Outer Conversion Phase | Position of Inner Iodide Conversion Phase | Coefficient of Variation (%) |
|---|---|---|---|---|---|---|---|---|
| (Invention) | | (10) | (69.5) | (20) | (0.4) | (0.1) | formation | |

TABLE 3

| Emulsion No. | AgI Content (mol %) (Ratio of Ag to Total Ag (%)) Total | Internal Nucleus | First Coat | Second Coat | Inner Conversion Phase | Outer Conversion Phase | Position of Inner Iodide Conversion Phase | Coefficient of Variation (%) | Se After-Ripening |
|---|---|---|---|---|---|---|---|---|---|
| Em-40 | 3.9 | 0 | 4.8 | 0 | 100 | 100 | 80% of grain | 9 | conducted |
| (Invention) | | (7) | (69) | (23) | (0.5) | (0.1) | formation | | |
| Em-41 | 3.9 | 0 | 4.8 | 0 | 100 | — | 80% of grain | 9 | conducted |
| (Comparison) | | (7) | (69) | (23) | (3.9) | | formation | | |
| Em-42 | 3.9 | 0 | 4.8 | 0 | 100 | 100 | 80% of grain | 9 | not |
| (Invention) | | (7) | (69) | (23) | (0.5) | (0.1) | formation | | conducted |
| Em-43 | 3.9 | 0 | 4.8 | 0 | 100 | — | 80% of grain | 9 | not |
| (Comparison) | | (7) | (69) | (23) | (3.9) | | formation | | conducted |

(2) Preparation of Coated Sample:

To each of the above emulsions were added polyvinylbenzenesulfonate as a thickener, a vinylsulfone compound as a hardening agent, and compound F-3 as a stabilizer to prepare the coating composition. The coating composition was uniformly applied on a polyester support having a subbing layer, and a surface protective layer mainly comprising an aqueous gelatin solution was applied thereon to prepare a coated sample containing each of Em-1 to 13, Em-20 to 37, and Em-40 to 43 (designated samples 101 to 113, 120 to 137, and 140 to 143, respectively).

The silver coverage of the emulsion layer was 2.0 g/m$^2$ and the gelatin coverage of the protective layer was 2.0 g/m$^2$ in every sample.

(3) Evaluation of Coated Samples:

a. Sensitivity:

Each of the samples other than samples 112 and 113 was exposed to light through a minus blue film for 1/100 second, and samples 112 and 113 were each exposed to light for the same exposure time without using a minus blue film. The exposed samples were developed with the following processing solution.

| Processing Solution | |
|---|---|
| 1-Phenyl-3-pyrazolidone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethylene glycol | 20 g |
| Sodium hydroxide to adjust to pH 10.0 | |
| Water to make | 1 l |

The results of sensitometry thus obtained are shown in Table 4. In the Table, sensitivity is expressed in terms of a relative value of the reciprocal of the exposure giving a density of (fog+0.2).

b. Incubation Resistance:

Each coated sample having been preserved in a freezer and each sample having been preserved at 50° C. and 55 RH % for 7 days were exposed and processed. The ratio of the sensitivity of these samples was obtained, and a difference in sensitivity between preserved sample and control sample (ΔS1) is shown in Tables 4 to 6. The smaller the absolute value of ΔS1, the more excellent the incubation resistance.

c. Latent Image Preservability:

Each coated sample was wedgewise exposed for 1/100 seconds, preserved at 50° C. and 40% for 14 days, and then processed in the same manner as above. A logarithm of the ratio of the sensitivity of the resulting processed sample to that of the corresponding sample having been processed immediately after exposure (ΔS2) was obtained. The results are shown in Tables 4 to 6. The smaller the absolute value of ΔS2, the more excellent the latent image preservability.

d. Stress Sensitiveness:

Each coated sample was conditioned at 25° C. and 40% RH, and folded at an angle of 180° along an iron rod having a diameter of 6 mm under these conditions. Immediately after the folding, the sample was wedgewise exposed for 1/100 seconds and processed in the same manner as above. A difference in sensitivity of the folded sample with that of a corresponding non-folded sample (ΔS3) was obtained. The results are shown in Tables 3 and 4. The smaller the absolute value of ΔS3, the lower the stress sensitiveness.

TABLE 4

| Sample No. | Emulsion No. | Relative Sensitivity | Incubation Resistance (Sensitivity of Preserved Sample) − (Sensitivity of Control Sample) | Latent Image Preservability (Sensitivity of Preserved Sample) − (Sensitivity of Control Sample) | Stress Sensitiveness (Sensitivity of Stressed Sample) − (Sensitivity of Control Sample) |
|---|---|---|---|---|---|
| 101 (Comparison) | Em-1 | 100 | −0.02 | +0.03 | +0.05 |
| 102 (Invention) | Em-2 | 114 | −0.02 | −0.01 | +0.01 |
| 103 (Comparison) | Em-3 | 115 | −0.15 | −0.13 | −0.12 |
| 104 (Comparison) | Em-4 | 81 | −0.02 | +0.02 | +0.03 |
| 105 (Invention) | Em-5 | 93 | −0.01 | −0.01 | ±0.00 |
| 106 (Comparison) | Em-6 | 93 | −0.12 | −0.10 | −0.10 |
| 107 (Comparison) | Em-7 | 55 | −0.02 | +0.02 | +0.02 |
| 108 (Invention) | Em-8 | 64 | −0.02 | −0.02 | ±0.00 |
| 109 (Comparison) | Em-9 | 65 | −0.10 | −0.20 | −0.09 |
| 110 (Invention) | Em-10 | 159 | −0.03 | −0.02 | −0.01 |
| 111 (Comparison) | Em-11 | 157 | −0.13 | −0.18 | −0.10 |
| 112 (Invention) | Em-12 | 123 | −0.03 | −0.03 | −0.02 |
| 113 (Comparison) | Em-13 | 122 | −0.12 | −0.20 | −0.11 |

TABLE 5

| Sample No. | Emulsion No. | Relative Sensitivity | Incubation Resistance (Sensitivity of Preserved Sample) − (Sensitivity of Control Sample) | Latent Image Preservability (Sensitivity of Preserved Sample) − (Sensitivity of Control Sample) | Stress Sensitiveness (Sensitivity of Stressed Sample) − (Sensitivity of Control Sample) |
|---|---|---|---|---|---|
| 120 (Invention) | Em-20 | 100 | −0.03 | −0.02 | ±0.00 |
| 121 (Invention) | Em-21 | 101 | −0.04 | −0.04 | −0.01 |
| 122 (Invention) | Em-22 | 98 | −0.05 | −0.05 | −0.02 |
| 123 (Invention) | Em-23 | 99 | −0.02 | −0.01 | ±0.00 |
| 124 (Invention) | Em-24 | 100 | −0.03 | −0.04 | −0.01 |
| 125 (Comparison) | Em-25 | 100 | −0.10 | −0.12 | −0.01 |
| 126 (Comparison) | Em-26 | 101 | −0.14 | −0.10 | −0.10 |
| 127 (Invention) | Em-27 | 100 | −0.03 | −0.02 | −0.01 |
| 128 (Invention) | Em-28 | 100 | −0.03 | −0.02 | −0.02 |
| 129 (Invention) | Em-29 | 100 | −0.05 | −0.04 | −0.03 |
| 130 (Comparison) | Em-30 | 98 | −0.10 | −0.12 | −0.12 |
| 131 (Invention) | Em-31 | 102 | −0.04 | −0.04 | −0.01 |
| 132 (Invention) | Em-32 | 104 | −0.05 | −0.05 | −0.01 |
| 133 (Invention) | Em-33 | 98 | −0.01 | −0.01 | −0.01 |
| 134 (Invention) | Em-34 | 97 | −0.04 | −0.03 | −0.02 |
| 135 | Em-35 | 95 | −0.05 | −0.05 | −0.02 |

TABLE 5-continued

| Sample No. | Emulsion No. | Relative Sensitivity | Incubation Resistance (Sensitivity of Preserved Sample) − (Sensitivity of Control Sample) | Latent Image Preservability (Sensitivity of Preserved Sample) − (Sensitivity of Control Sample) | Stress Sensitiveness (Sensitivity of Stressed Sample) − (Sensitivity of Control Sample) |
|---|---|---|---|---|---|
| (Invention | | | | | |
| 136 | Em-36 | 70 | −0.18 | −0.25 | −0.05 |
| (Comparison) | | | | | |
| 137 | Em-37 | 101 | −0.01 | −0.01 | ±0.00 |
| (Invention | | | | | |

TABLE 6

| Sample No. | Emulsion No. | Relative Sensitivity | Incubation Resistance (Sensitivity of Preserved Sample) − (Sensitivity of Control Sample) | Latent Image Preservability (Sensitivity of Preserved Sample) − (Sensitivity of Control Sample) | Stress Sensitiveness (Sensitivity of Stressed Sample) − (Sensitivity of Control Sample) |
|---|---|---|---|---|---|
| 140 | Em-40 | 100 | −0.01 | ±0.00 | −0.01 |
| (Invention) | | | | | |
| 141 | Em-41 | 98 | −0.10 | −0.12 | −0.06 |
| (Comparison) | | | | | |
| 142 | Em-42 | 81 | −0.05 | −0.01 | −0.03 |
| (Invention) | | | | | |
| 143 | Em-43 | 80 | −0.11 | −0.09 | −0.05 |
| (Comparison) | | | | | |

It is seen from Tables 4, 5, and 6 that the emulsions according to the present invention have high sensitivity and exhibit satisfactory properties in terms of latent image preservability, incubation resistance and stress sensitiveness.

Making comparisons, for example, between samples 102 and 101, between samples 105 and 104, and between samples 108 and 107, samples using grains having a 5-layered structure according to the present invention have higher sensitivity, more excellent latent image preservability, and lower stress sensitiveness than those using grains having a 4-layered structure with no iodide conversion layer. Comparing sample 102 with sample 103, sample 105 with sample 106, sample 108 with sample 109, sample 110 with sample 111, and sample 112 with sample 113, it is apparent that the 5-layered grains according to the present invention are more satisfactory in latent image preservability, incubation resistance, and stress sensitiveness than the 4-layered grains having only iodide conversion layers. As can be seen from the data of samples 120 through 137, these grains of the present invention exhibit particularly outstanding effects when they fall within the range of the present invention. From the results of samples 140 to 143, it is seen that the effects of the present invention are outstanding where a selenium compound according to the present invention is present.

EXAMPLE 2

(1) Preparation of Sample 201:

A multilayer color light-sensitive material was prepared by providing multiple layers having the following compositions on a 127 μm thick triacetyl cellulose film support having a subbing layer. The resulting material was designated sample 201. The numerals shown below are amounts used per $m^2$. The effect of the compound used is not limited to that described.

| | |
|---|---|
| **First Layer: Antihalation Layer** | |
| Black colloidal silver | 0.30 g |
| Gelatin | 2.30 g |
| UV absorbent U-1 | 0.10 g |
| UV Absorbent U-3 | 0.040 g |
| UV Absorbent U-4 | 0.10 g |
| High-boiling organic solvent Oil-1 | 0.10 g |
| Solid dispersion of crystallites of dye E-1 | 0.26 g |
| Solid dispersion of crystallites of dye E-2 | 0.14 g |
| **Second Layer: Intermediate Layer** | |
| Gelatin | 0.40 g |
| Compound Cpd-A | 5.0 mg |
| Compound Cpd-E | 5.0 mg |
| High-boiling organic solvent Oil-3 | 0.10 g |
| Dye D-4 | 10.0 mg |
| Dye D-5 | 4.0 mg |
| **Third Layer: Intermediate Layer** | |
| Yellow colloidal silver | 0.010 g-Ag |
| Surface and inside-fogged silver iodobromide fine grains emulsion (mean grain size: 0.06 μm; coefficient of variation: 10%; silver iodide content: 1 mol %) | 0.050 g-Ag |
| Gelatin | 0.40 g |
| **Fourth Layer: Low Sensitivity Red-Sensitive Emulsion Layer** | |
| Emulsion | 0.69 g-Ag |
| Surface and internally-fogged silver iodobromide fine grains emulsion (mean grain size: 0.15 μm; coefficient of variation: 10%; silver iodide content: 1 mol %) | 0.050 g-Ag |
| Gelatin | 0.80 g |
| Coupler C-1 | 0.10 g |
| Coupler C-2 | 0.04 g |
| Coupler C-6 | 0.050 g |
| Compound Cpd-A | 5.0 mg |
| Compound Cpd-E | 5.0 mg |

-continued

| | |
|---|---|
| High-boiling organic solvent Oil-2 | 0.10 g |

Fifth Layer: Middle Sensitivity Red-Sensitive Emulsion Layer

| | |
|---|---|
| Emulsion | 0.50 g-Ag |
| Internally-fogged silver iodobromide fine grains emulsion (mean grain size: 0.15 μm; coefficient of variation: 10%; silver iodide content: 1 mol %) | 0.050 g |
| Gelatin | 0.80 g |
| Coupler C-1 | 0.13 g |
| Coupler C-2 | 0.06 g |
| Coupler C-6 | 0.01 g |
| High-boiling organic solvent Oil-2 | 0.10 g |

Sixth Layer: High Sensitivity Red-Sensitive Emulsion Layer:

| | |
|---|---|
| Emulsion | 0.50 g-Ag |
| Gelatin | 1.70 g |
| Coupler C-3 | 0.70 g |
| Coupler C-6 | 0.02 g |
| Additive P-1 | 0.20 g |
| High-boiling organic solvent Oil-2 | 0.04 g |

Seventh Layer: Intermediate Layer

| | |
|---|---|
| Gelatin | 0.60 g |
| Compound Cpd-D | 0.04 g |
| Compound Cpd-G | 0.16 g |
| Solid dispersion of fine crystal of dye E-4 | 0.02 g |

Eighth Layer: Intermediate Layer

| | |
|---|---|
| Yellow colloidal silver | 0.040 g-Ag |
| Surface and internally-fogged silver iodobromide fine grains emulsion (mean grain size: 0.06 μm; coefficient of variation: 10%; silver iodide content: 1 mol %) | 0.020 g |
| Gelatin | 1.20 g |
| Compound Cpd-A | 0.10 g |
| Compound Cpd-B | 0.10 g |
| Compound Cpd-C | 0.17 g |
| High-boiling organic solvent Oil-3 | 0.20 g |

Ninth Layer: Low Sensitivity Green-Sensitive Emulsion Layer

| | |
|---|---|
| Emulsion | 0.95 g-Ag |
| Internally-fogged silver iodobromide fine grains emulsion (mean grain size: 0.15 μm; coefficient of variation: 10%; silver iodide content: 1 mol %) | 0.04 g-Ag |
| Surface and internally-fogged silver iodobromide fine grains emulsion (mean grain size: 0.06 μm; coefficient of variation: 10%; silver iodide content: 1 mol %) | 0.04 g-Ag |
| Gelatin | 0.50 g |
| Coupler C-7 | 0.03 g |
| Coupler C-8 | 0.09 g |
| Coupler C-10 | 0.04 g |
| Coupler C-11 | 0.04 g |
| Compound Cpd-A | 0.01 g |
| Compound Cpd-E | 0.01 g |
| Compound Cpd-F | 0.03 g |
| High-boiling organic solvent Oil-2 | 0.10 g |

Tenth Layer: Middle Sensitivity Green-Sensitive Emulsion Layer

| | |
|---|---|
| Emulsion | 0.50 g-Ag |
| Internally-fogged silver iodobromide fine grains emulsion (mean grain size: 0.15 μm; coefficient of variation: 10%; silver iodide content: 1 mol %) | 0.04 g-Ag |
| Surface and internally-fogged iodobromide fine grains emulsion (mean grain size 0.06 μm; coefficient of variation: 10%; silver iodide content: 1 mol %) | 0.04 g-Ag |
| Gelatin | 0.50 g |
| Coupler C-4 | 0.12 g |
| Coupler C-10 | 0.06 g |
| Coupler C-11 | 0.06 g |
| Compound Cpd-F | 0.03 g |
| High-boiling organic solvent Oil-2 | 0.01 g |

-continued

Eleventh Layer: High sensitivity Green-Sensitive Emulsion Layer

| | |
|---|---|
| Emulsion | 0.44 g-Ag |
| Gelatin | 0.50 g |
| Coupler C-4 | 0.18 g |
| Coupler C-10 | 0.09 g |
| Coupler C-11 | 0.09 g |
| Compound Cpd-F | 0.080 g |
| High-boiling organic solvent Oil-2 | 0.020 g |

Twelfth Layer: Intermediate Layer

| | |
|---|---|
| Gelatin | 0.30 g |

Thirteenth Layer: Yellow Filter Layer

| | |
|---|---|
| Yellow colloidal silver | 0.08 g-Ag |
| Gelatin | 0.50 g |
| Compound Cpd-B | 0.02 g |
| Compound Cpd-D | 0.03 g |
| Compound Cpd-G | 0.11 g |
| Solid dispersion of fine crystal of dye E-3 | 0.27 g |

Fourteenth Layer: Low Sensitivity Blue-Sensitive Emulsion Layer

| | |
|---|---|
| Emulsion | 0.43 g-Ag |
| Gelatin | 0.80 g |
| Coupler C-5 | 0.30 g |
| Coupler C-6 | 5.0 mg |
| Coupler C-9 | 0.03 g |

Fifteenth Layer: Middle Sensitivity Blue-Sensitive Emulsion Layer

| | |
|---|---|
| Emulsion | 0.16 g-Ag |
| Gelatin | 0.60 g |
| Coupler C-5 | 0.30 g |
| Coupler C-6 | 5.0 mg |
| Coupler C-9 | 0.03 g |

Sixteenth Layer: High Sensitivity Blue-Sensitive Emulsion Layer

| | |
|---|---|
| Emulsion | 0.47 g-Ag |
| Gelatin | 2.60 g |
| Coupler C-5 | 0.10 g |
| Coupler C-6 | 0.12 g |
| Coupler C-9 | 1.10 g |
| High-boiling organic solvent Oil-2 | 0.40 g |

Seventeenth Layer: 1st Protective Layer

| | |
|---|---|
| Gelatin | 1.00 g |
| UV Absorbent U-1 | 0.10 g |
| UV Absorbent U-2 | 0.03 g |
| UV Absorbent U-5 | 0.20 g |
| Dye D-1 | 0.15 g |
| Dye D-2 | 0.050 g |
| Dye D-3 | 0.10 g |
| Dye D-4 | 0.01 g |
| Compound Cpd-H | 0.40 g |
| High-boiling organic solvent Oil-2 | 0.30 g |

Eighteenth Layer: 2nd Protective Layer

| | |
|---|---|
| Colloidal silver | 0.10 mg-Ag |
| Silver iodobromide fine grains emulsion (mean grain size: 0.06 μm; silver iodide content: 1 mol %) | 0.10 g-Ag |
| Gelatin | 0.70 g |
| UV Absorbent U-1 | 0.06 g |
| UV Absorbent U-2 | 0.02 g |
| UV Absorbent U-5 | 0.12 g |
| High-boiling organic solvent Oil-2 | 0.07 g |

Nineteenth Layer: 3rd Protective Layer

| | |
|---|---|
| Gelatin | 1.40 g |
| Polymethyl methacrylate (average particle size: 1.5 μm) | 5.0 mg |
| Methyl methacrylate/acrylic acid copolymer (4:6) (average particle size: 1.5 μm) | 0.10 g |
| Silicone oil | 0.030 g |

The light-sensitive silver halide emulsions used above are shown in Tables 7 and 8.

In Table 7, emulsions A, B, G, I, K, M, N, O, R, and S are silver iodide emulsions having an iodide conversion phase in the inside of the grains. Other emulsions have a high iodide phase having a silver iodide content of not more than 40 mol % in the inside of the grains.

TABLE 7

Light-Sensitive Emulsions Used in Sample 101

| Layer Where Emulsion is Used | Emulsion | Silver Coverage ($g/m^2$) | Average Aspect Ratio | Circle-Equivalent Projected Area Diameter: Mean Grain Size (μm) | Circle-Equivalent Projected Area Diameter: Coefficient of Variation (%) | AgI Content: Average (mol %) | AgI Content: Coefficient of Variation (%) |
|---|---|---|---|---|---|---|---|
| Low sensitivity red-sensitive emulsion layer | A | 0.20 | 1.0 | 0.24 | 13 | 3.5 | 35 |
| | B | 0.30 | 1.0 | 0.25 | 10 | 3.6 | 30 |
| | C | 0.20 | 1.0 | 0.25 | 10 | 3.3 | 10 |
| Middle sensitivity red-sensitive emulsion layer | Em-1 | 0.50 | 1.0 | 0.40 | 8 | 3.5 | 10 |
| High sensitivity red-sensitive emulsion layer | E | 0.50 | 2.8 | 0.85 | 8 | 1.6 | 15 |
| | F | 0.50 | 2.8 | 0.85 | 8 | 1.6 | 15 |
| Low sensitivity green-sensitive emulsion layer | G | 0.25 | 1.0 | 0.20 | 15 | 4.0 | 20 |
| | H | 0.40 | 1.0 | 0.25 | 11 | 4.0 | 20 |
| | I | 0.30 | 1.0 | 0.40 | 9 | 3.9 | 15 |
| Middle sensitivity green-sensitive emulsion layer | J | 0.20 | 1.0 | 0.40 | 9 | 3.5 | 20 |
| | K | 0.26 | 1.0 | 0.50 | 9 | 3.2 | 25 |
| High sensitivity green-sensitive emulsion layer | L | 0.44 | 4.5 | 1.40 | 25 | 1.6 | 35 |
| Low sensitivity blue-sensitive emulsion layer | M | 0.20 | 1.0 | 0.30 | 12 | 4.7 | 25 |
| | N | 0.05 | 1.0 | 0.36 | 8 | 4.7 | 8 |
| | O | 0.18 | 1.0 | 0.50 | 10 | 4.7 | 20 |
| Middle sensitivity blue-sensitive emulsion layer | P | 0.08 | 2.1 | 0.60 | 18 | 2.0 | 15 |
| | Q | 0.08 | 3.1 | 0.90 | 7 | 2.5 | 10 |
| High sensitivity blue-sensitive emulsion layer | R | 0.20 | 8.2 | 1.70 | 25 | 1.2 | 30 |
| | S | 0.26 | 12.6 | 2.60 | 5 | 1.2 | 25 |

TABLE 8

| Emulsion | Characteristics of Grains | Ratio of (111) in the Total Surface | Main Position of Latent Image Formation | Kind (Amount: mg/mol-Ag) of Sensitizing Dyes Added |
|---|---|---|---|---|
| A | tetradecahedral grains | 45 | surface | S-1 (250), S-2 (12), S-3 (3), S-4 (25) |
| B | tetradecahedral grains | 35 | surface | S-2 (4), S-2 (381), S-3 (8), S-4 (20) |
| C | cubic grains | 0 | internal | S-1 (10), S-2 (264), S-3 (41), S-4 (14) |
| D | tetradecahedral grains | 50 | surface | S-1 (267), S-2 (5), S-3 (2), S-4 (105) |
| E | tabular grains | 99 | internal | S-1 (66), S-2 (240), S-3 (22), S-4 (11) |
| F | tabular grains | 1 | surface | S-1 (46), S-2 (220), S-3 (22), S-4 (10) |
| G | cubic grains | 2 | internal | S-5 (544), S-6 (128), S-7 (7), S-8 (6), S-9 (20), S-10 (10) |
| H | cubic grains | 1 | internal | S-5 (422), S-6 (122), S-7 (10), S-8 (5), S-9 (8), S-10 (9) |
| I | cubic grains | 0 | internal | S-5 (479), S-6 (86), S-7 (8), S-8 (4), S-9 (9), S-10 (11) |
| J | cubic grains | 0 | surface | S-5 (479), S-6 (86), S-7 (9), S-8 (10), S-9 (9), S-10 (4) |
| K | cubic grains | 5 | surface | S-5 (273), S-6 (5), S-7 (5), S-8 (55), S-9 (10), S-10 (2) |
| L | tabular grains | 98 | surface | S-5 (2), S-6 (2), S-7 (3), S-8 (7), S-9 (71), S-10 (33) |
| M | tetradecahedral grains | 55 | surface | S-11 (84), S-12 (185) |
| N | tetradecahedral grains | 50 | surface | S-11 (76), S-12 (170) |
| O | tetradecahedral grains | 45 | surface | S-11 (54), S-12 (119) |
| P | cubic grains | 1 | surface | S-11 (49), S-12 (260) |
| Q | tabular grains | 1 | surface | S-11 (40), S-12 (207) |
| R | tabular grains | 4 | surface | S-11 (36), S-12 (187) |
| S | tabular grains | 1 | surface | S-11 (33), S-12 (173) |

Note:
1): Compounds F-1, F-3, F-7, F-8, F-9, and F-10 were added appropriately to these emulsions.
2): The ratio of (111) in the total surface was obtained by Kubelka-Munk model.

In addition to the above compositions, additives F-1 to F-8, surface active agents W-1 to W-6, and gelatin hardening agent H-1 were added.
Phenol, 1,2-benzisothiazolin-3-one, 2-phenoxyethanol, phenethyl alcohol and butyl p-benzoate were also added as an antiseptic or an antifungal agent.
C-1
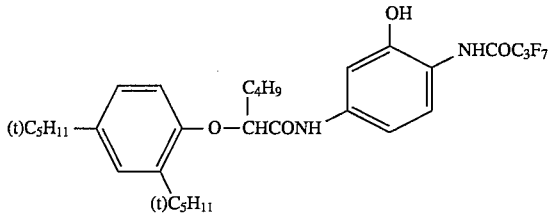
C-2
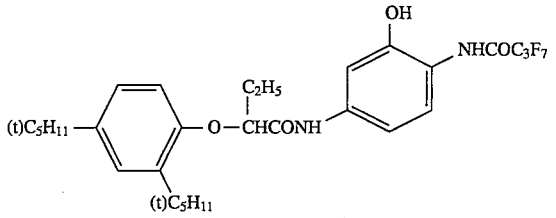
C-3
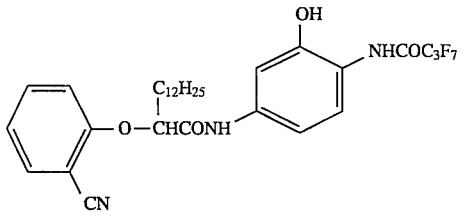
C-4
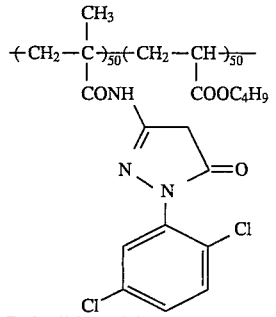
Ratio: % by weight
Average mol. wt.: ca. 25000
C-5
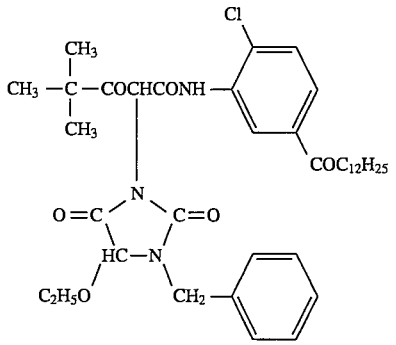

-continued
C-6
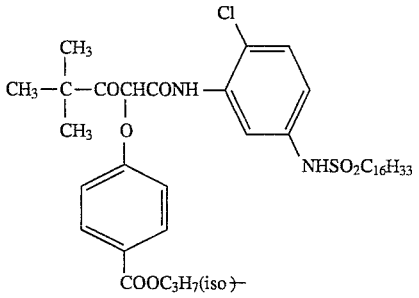
C-7
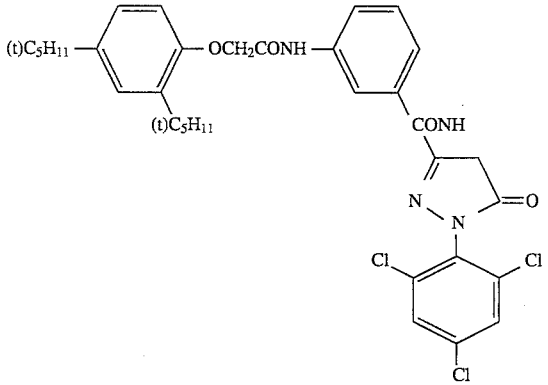
C-8
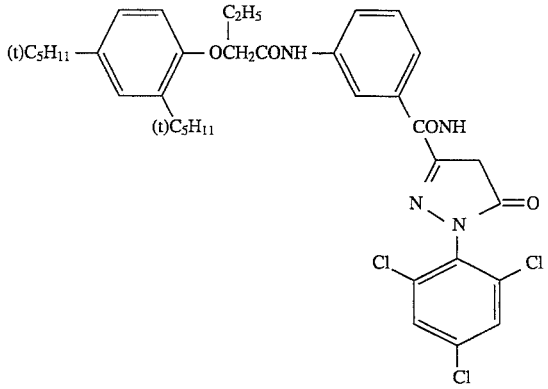
C-9
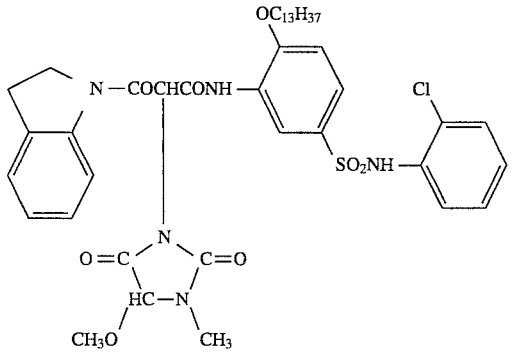
Oil-1: Dibutyl phthalate
Oil-2: Tricresyl phosphate
Oil-3:
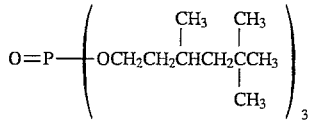

-continued
C-10
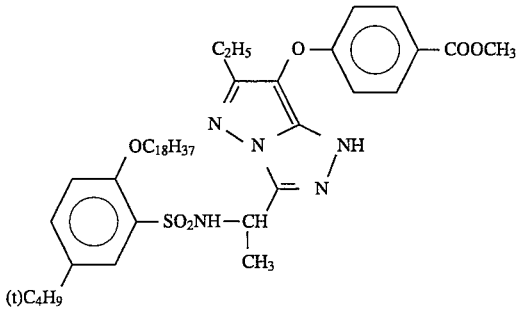
C-11
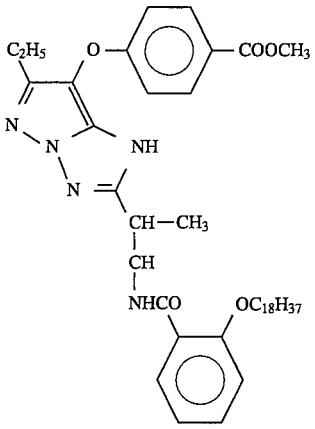
U-1
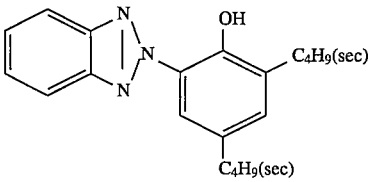
U-2
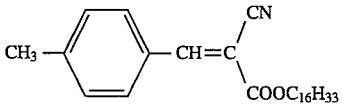
U-3
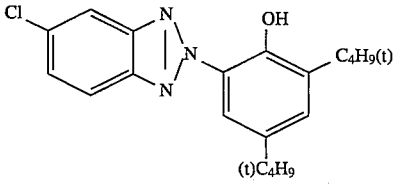
U-4
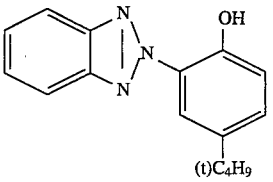
U-5
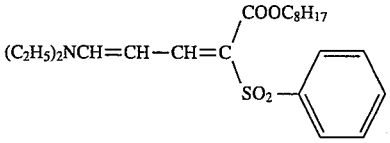

-continued
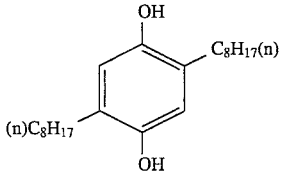
Cpd-A
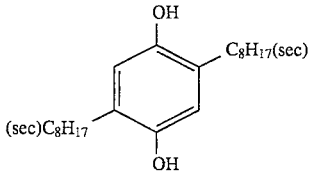
Cpd-B
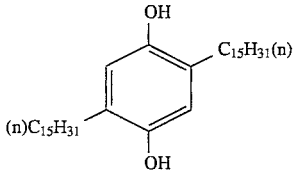
Cpd-C
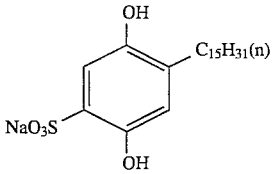
Cpd-D
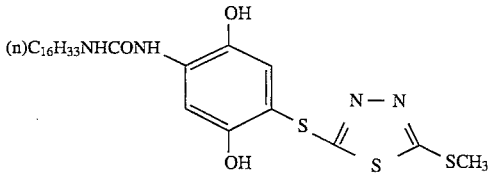
Cpd-E
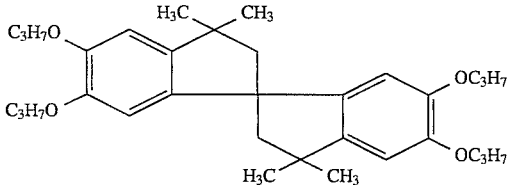
Cpd-F
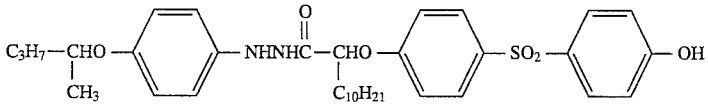
Cpd-G
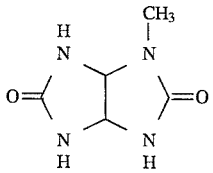
Cpd-H
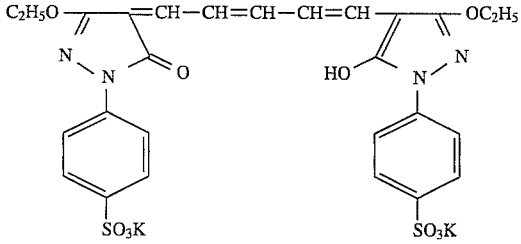
D-1

-continued
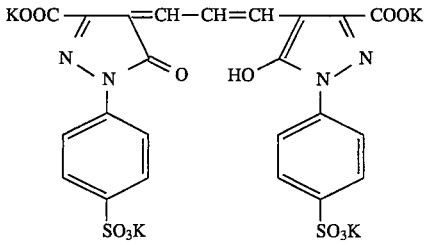
D-2
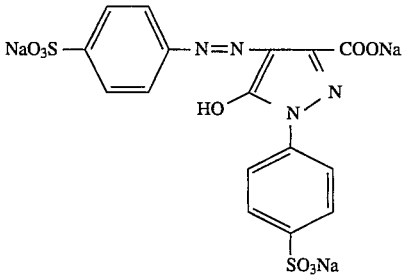
D-3
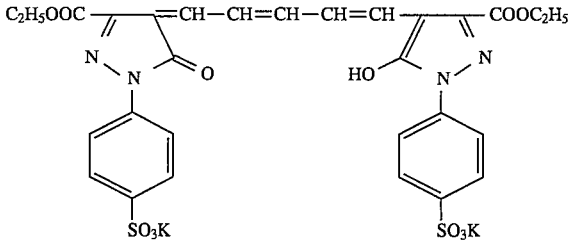
D-4
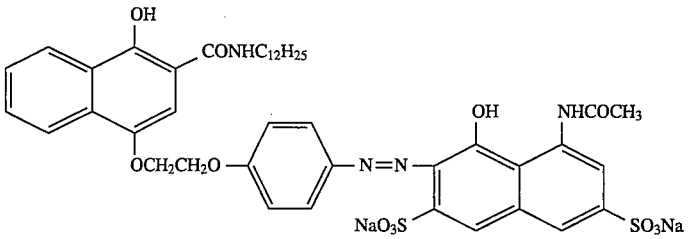
D-5
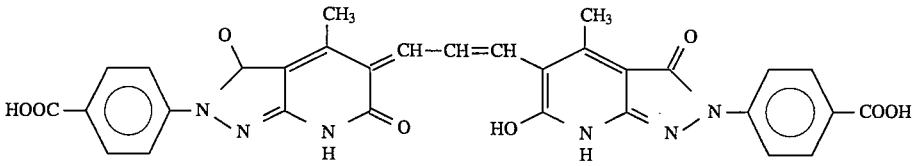
E-1
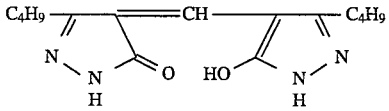
E-2
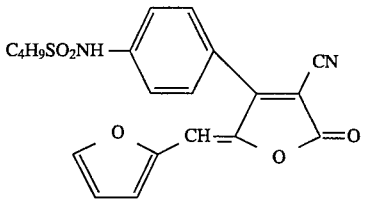
E-3

-continued
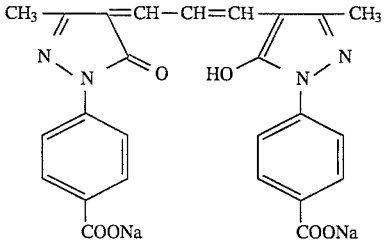
E-4
$C_8F_{17}SO_2N(C_3H_7)CH_2COOK$
W-2
$NaO_3S-CH(CH_2COOCH_2CH(C_2H_5)C_4H_9)COOCH_2CH(C_2H_5)C_4H_9$
W-3
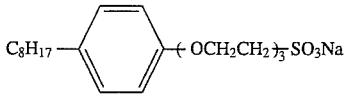
W-4
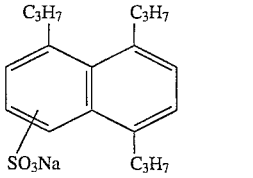
W-5
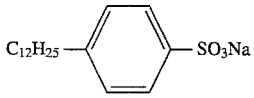
W-6
$(CH_2-CH(CONHC_4H_9(t)))_n$
P-1
$(CH_2-CH(COOC_4H_9))_n$
M-1
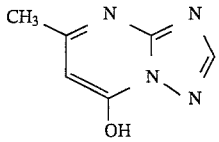
F-1
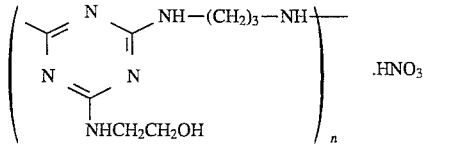
F-2
(n = 3~4)
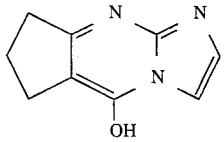
F-3
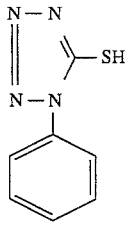
F-4

-continued
F-5
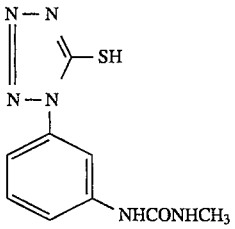
F-6
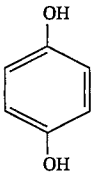
F-7
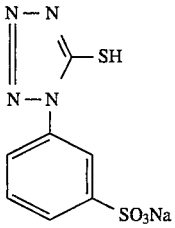
F-8
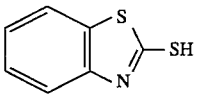
S-1
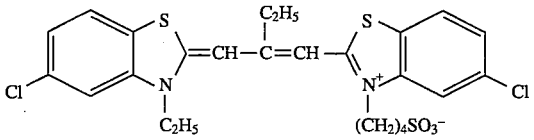
S-2
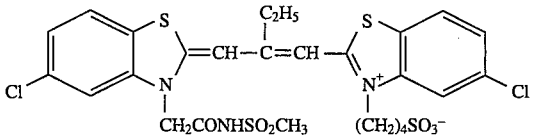
S-3
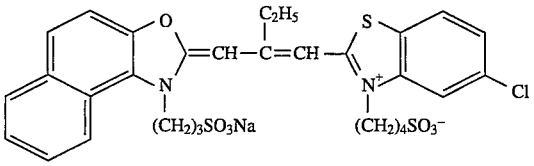
S-4
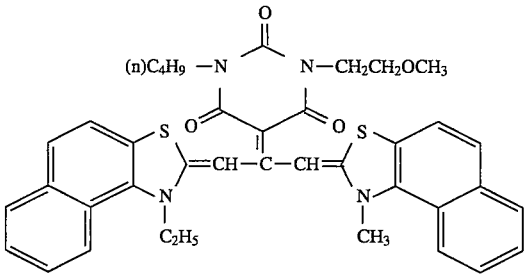
S-5
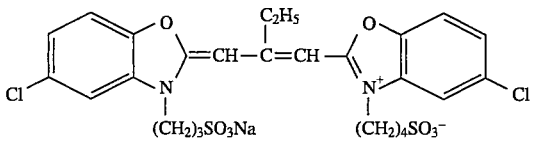

-continued

S-6

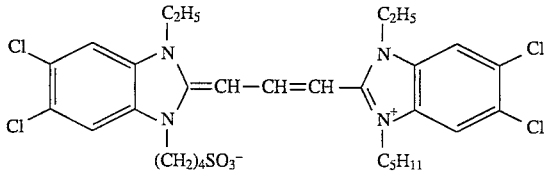

S-7

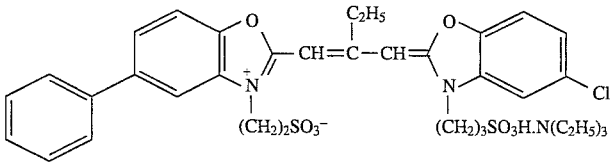

S-8

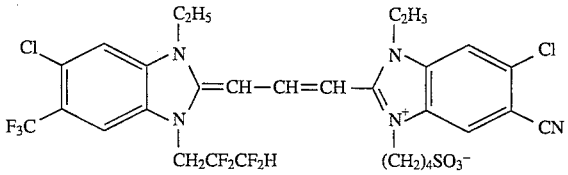

S-9

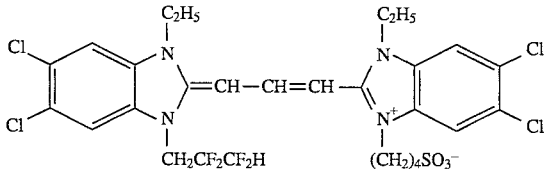

S-10

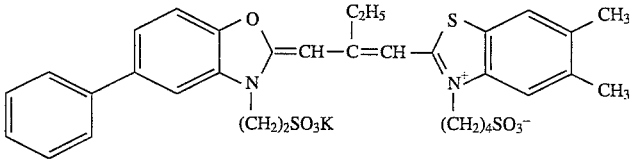

S-11

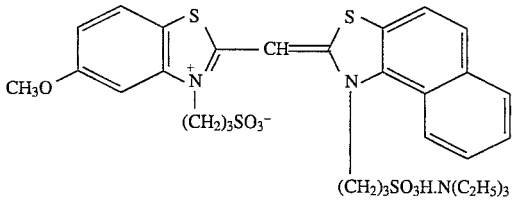

S-12

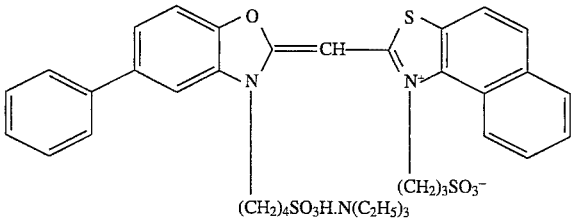

(2) Preparation of Samples 202 to 243:

(a) Samples 201 to 209, (b) samples 210 and 211, (c) samples 220 to 237, (d) samples 240 to 243, and (e) samples 212 and 213 were prepared by (a) replacing emulsion Em-1 to be added to the fifth layer of sample 201 with each of Em-2 to Em-9, (b) replacing emulsion E to be used in the sixth layer with Em-10 or Em-11, (c) replacing emulsion K to be added to the tenth layer with each of Em-20 to 37 or (d) with each of Em-40 to 43, and (e) replacing emulsion R of the sixteenth layer with Em-12 or Em-13, respectively.

(3) Evaluation of Samples:

a. Sensitivity

Each of samples 201 to 213, 220 to 237, and 240 to 243 was wedgewise exposed to white light from a light source having a color temperature of 4800K (2000 lux) for 1/50 second and processed as follows. The sensitivity of the samples was evaluated in terms of a relative value of a reciprocal of a relative exposure giving a cyan density of 1.0 in the case of samples 201 to 209, a cyan density of 2.0 in the case of samples 210 to 211, a yellow density of 2.0 in the case of samples 212 to 213, and a magenta density of 1.0 in the case of samples 220 to 237 and 240 to 243.

b. Incubation Resistance:

Each sample having been preserved in a freezer and each sample having been preserved at 50° C. and 55%RH for 7 days were exposed to light and processed, and the difference in sensitivity of these samples was obtained. The smaller the difference, the more excellent the preservation stability.

c. Latent Image Preservability:

An wedgewise exposed sample was preserved at 50° C. and 40%RH for 14 days and then processed in the same manner as above. A difference in sensitivity between the resulting processed sample and that of the corresponding sample having been processed immediately after exposure was obtained. The smaller the difference, the more excellent the latent image preservability.

Processing Conditions:

| Processing Step | Time | Temperature |
|---|---|---|
| First Development | 6 min | 38° C. |
| Washing | 2 min | 38° C. |
| Reversing | 2 min | 38° C. |
| Color development | 6 min | 38° C. |
| Pre-bleaching | 2 min | 38° C. |
| Bleaching | 6 min | 38° C. |
| Fixing | 4 min | 38° C. |
| Washing | 4 min | 38° C. |
| Final rinsing | 1 min | 25° C. |

Each processing solution had the following composition.

| | |
|---|---|
| **First Developer:** | |
| Pentasodium nitrilo-N,N,N-trimethylene-phosphonate | 1.5 g |
| Pentasodium diethylenetriaminepentaacetate | 2.0 g |
| Sodium sulfite | 30 g |
| Potassium hydroquinonemonosulfonate | 20 g |
| Potassium carbonate | 15 g |
| Sodium hydrogencarbonate | 12 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water to make | 1000 ml |
| pH (adjusted with sulfuric acid or potassium hydroxide) | 9.60 |
| **Reversal Solution:** | |
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH (adjusted with acetic acid or sodium hydroxide) | 6.00 |
| **Color Developer:** | |
| Pentasodium nitrilo-N,N,N-trimethylene-phosphonate | 2.0 g |
| Sodium sulfite | 7.0 g |
| Sodium tertiary phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamidoethyl)-3-methyl-4-aminoaniline sesquisulfate monohydrate | 11 g |
| 3,6-Dithiaoctane-1,8-diol | 1.0 g |
| Water to make | 1000 ml |
| pH (adjusted with sulfuric acid or potassium hydroxide) | 11.80 |
| **Pre-Bleaching Solution:** | |
| Disodium ethylenediaminetetraacetate dihydrate | 8.0 g |

-continued

| | |
|---|---|
| Sodium sulfite | 6.0 g |
| 1-Thioglycerol | 0.4 g |
| Formaldehyde-sodium bisulfite adduct | 30 g |
| Water to make | 1000 ml |
| pH (adjusted with acetic acid or sodium hydroxide | 6.20 |
| **Bleaching Solution:** | |
| Disodium ethylenediaminetetraacetate dihydrate | 2.0 g |
| Ammonium (ethylenediaminetetraacetato)iron (III) dihydrate | 120 g |
| Potassium bromide | 100 g |
| Ammonium nitrate | 10 g |
| Water to make | 1000 ml |
| pH (adjusted with nitric acid or sodium hydroxide) | 5.70 |
| **Fixer:** | |
| Ammonium thiosulfate | 80 g |
| Sodium sulfite | 5.0 g |
| Sodium hydrogensulfite | 5.0 g |
| Water to make | 1000 ml |
| pH (adjusted with acetic acid or aqueous ammonia) | 6.60 |
| **Final Rinsing Solution:** | |
| 1,2-Benzisothiazolin-3-one | 0.02 g |
| Polyoxyethylene-p-monononylphenyl ether (average degree of polymerization: 10) | 0.3 g |
| Polymaleic acid (average molecular weight: 2000) | 0.1 g |
| Water to make | 1000 ml |
| pH | 7.0 |

Similarly to the results of samples 101 to 143, the samples containing the emulsion of the present invention had high sensitivity, satisfactory latent image preservability and satisfactory incubation resistance. The effects of the present invention were outstanding where the selenium compound of the present invention is present.

(3) Preparation of Samples 301 to 313:

Samples 301 to 305 were prepared in the same manner as for sample 201, except for replacing emulsion Em-1 to be added to the fifth layer with emulsion D, replacing emulsion K to be added to the tenth layer with Em-10, adding an inside-fogged silver iodobromide fine grains emulsion (mean grain size: 0.15 μm; coefficient of variation: 10%; silver iodide content: 1 mol %; hereinafter referred to as fogged fine grains) and compound F-3 to the tenth layer as shown in Table 10 below, and replacing emulsion L to be added to the sixth layer with emulsion T shown in Table 9.

TABLE 9

| Emulsion | Characteristics of Grains | Ratio of (111) in the Total Surface | Main Position of Latent Image Formation | Kind (Amount: mg/mol-Ag) of Sensitizing Dyes Added |
|---|---|---|---|---|
| T | tetradecahedral grains | 45 | surface | S-5 (2), S-6 (3), S-7 (200), S-8 (6), S-9 (63), S-10 (20) |
| U | cubic grains | 58 | surface | S-1 (40), S-2 (190), S-3 (18), S-4 (8) |

TABLE 10

| Sample No. | Additives to 10th Layer: Compound F-3 (g) | Fogged Fine Grains (g-Ag) | Emulsion used in 11th Layer |
|---|---|---|---|
| 301 | 0.0 | 0.00 | emulsion L |
| 302 | $3 \times 10^{-4}$ | " | " |
| 303 | " | 0.05 | " |
| 304 | 0.0 | 0.00 | emulsion T |
| 305 | $3 \times 10^{-4}$ | 0.05 | " |

Samples 306 to 314 were prepared in the same manner as for sample 201, except for replacing emulsion Em-1 to be added to the fifth layer and emulsions E and F to be added to the sixth layer with the respective emulsion(s) shown in Table 11 and adding surface and inside-fogged fine grains and compound F-3 to the fifth layer as shown in Table 11.

TABLE 11

| Sample No. | Additive to 5th Layer: Compound F-3 (g) | Fogged Fine Grains (g-Ag) | Emulsion used in 5th Layer | Emulsion(s) used in 6th Layer |
|---|---|---|---|---|
| 306 | 0.0 | 0.00 | Em-2 | emulsions E and F |
| 307 | $5 \times 10^{-4}$ | " | " | emulsions E and F |
| 308 | " | 0.10 | " | emulsions E and F |

TABLE 11-continued

| Sample No. | Additive to 5th Layer: Compound F-3 (g) | Fogged Fine Grains (g-Ag) | Emulsion used in 5th Layer | Emulsion(s) used in 6th Layer |
|---|---|---|---|---|
| 309 | 0.0 | 0.00 | " | emulsion U |
| 310 | $5 \times 10^{-4}$ | 0.10 | " | " |
| 311 | " | " | Em-5 | emulsions E and F |
| 312 | " | " | Em-8 | emulsions E and F |
| 313 | " | " | Em-1 | emulsions E and F |
| 314 | " | " | Em-3 | emulsions E and F |

(3) Evaluation of Samples:

The sensitivity, incubation resistance, and latent image preservability of the resulting samples were evaluated in the same manner as for samples 201 to 230. The evaluation was made with respect to the magenta sensitivity as for samples 301 to 305 and with respect to the cyan sensitivity as for samples 306 to 313. The results obtained are shown in Tables 12 and 13. Further, the sharpness was evaluated by exposing each sample to white light through a pattern for MTF measurement and obtaining an MTF at a spatial frequency of 10 c/mm and 30 c/mm with respect to a magenta color image as for samples 301 to 305 or with respect to a cyan color image as for samples 306 to 313.

TABLE 12

| Sample No. | Relative Magenta Sensitivity | Performance of Coated Samples 301 to 305: Sharpness 10 c/mm | Sharpness 30 c/mm | Incubation Resistance (Sensitivity of Preserved Sample) – of (Sensitivity Control Sample) | Latent Image Preservability (Sensitivity of Preserved Sample) – (Sensitivity of Control Sample) |
|---|---|---|---|---|---|
| 301 (Invention) | 100 | 1.20 | 0.44 | –0.07 | –0.02 |
| 302 (Invention) | 106 | 1.21 | 0.45 | –0.02 | +0.01 |
| 303 (Invention) | 111 | 1.28 | 0.50 | –0.03 | ±0.00 |
| 304 (Invention) | 101 | 1.01 | 0.33 | –0.07 | –0.03 |
| 305 (Invention) | 110 | 1.03 | 0.36 | –0.02 | ±0.00 |

TABLE 13

| Sample No. | Relative Cyan Sensitivity | Performance of Coated Samples 306 to 314: Sharpness 10 c/mm | Sharpness 30 c/mm | Incubation Resistance (Sensitivity of Preserved Sample) – (Sensitivity of Control Sample) | Latent Image Preservability (Sensitivity of Preserved Sample) – (Sensitivity of Control Sample) |
|---|---|---|---|---|---|
| 306 | 100 | 1.20 | 0.45 | –0.06 | –0.04 |

TABLE 13-continued

| Sample No. | Relative Cyan Sensitivity | Performance of Coated Samples 306 to 314: Sharpness 10 c/mm | Sharpness 30 c/mm | Incubation Resistance (Sensitivity of Preserved Sample) – (Sensitivity of Control Sample) | Latent Image Preservability (Sensitivity of Preserved Sample) – (Sensitivity of Control Sample) |
|---|---|---|---|---|---|
| (Invention) 307 | 106 | 1.21 | 0.45 | −0.01 | −0.01 |
| (Invention) 308 | 111 | 1.29 | 0.51 | −0.01 | ±0.00 |
| (Invention) 309 | 99 | 1.01 | 0.36 | −0.06 | −0.05 |
| (Invention) 310 | 109 | 1.04 | 0.38 | −0.01 | ±0.00 |
| (Invention) 311 | 110 | 1.30 | 0.50 | −0.01 | ±0.00 |
| (Invention) 312 | 109 | 1.29 | 0.49 | −0.01 | ±0.00 |
| (Invention) 313 | 95 | 1.27 | 0.48 | −0.01 | +0.02 |
| (Comparison) 314 (Comparison) | 109 | 1.27 | 0.49 | −0.09 | −0.08 |

As can be seen from Tables 12 and 13, where compound F-3 is used in the emulsion layer containing the emulsion of the present invention, the sensitivity increases, and the incubation resistance and latent image preservability are improved. Where fogged fine grains are used in the emulsion layer containing the emulsion of the present invention, not only sensitivity but sharpness are improved. Further, where a tabular silver halide emulsion is used in a layer which is in the layer unit containing the emulsion of the present invention and is farther from the support than that emulsion layer, the effect of improving sharpness becomes conspicuous.

For example, comparing sample 301 with sample 302 and comparing sample 306 and sample 307, those containing compound F-3 in the layer containing the emulsion of the present invention have high sensitivity and satisfactory incubation resistance and satisfactory latent image preservability. Comparing sample 302 with sample 303 and comparing sample 307 with sample 308, those containing fogged fine grains in the layer containing the emulsion of the present invention have higher sensitivity and improved sharpness. Further, from comparisons between samples 301 and 304, between samples 303 and 305, between samples 306 and 309, and between samples 308 and 310, it is seen that those containing a tabular silver halide emulsion in a layer which is in the same unit as the silver halide emulsion layer according to the present invention and is farther from the support than that silver halide emulsion layer show marked improvement in sharpness.

The silver halide emulsion and silver halide light-sensitive material according to the present invention undergo reduced photographic change by stress imposition and have high sensitivity, satisfactory latent image preservability, and satisfactory incubation resistance.

While the invention has been described in detail and with reference to specific embodiments thereof, it will be apparent to one skilled in the art that various changes and modifications can be made therein without departing from the spirits and scope thereof.

What is claimed is:

1. A silver halide light-sensitive emulsion containing silver halide emulsion grains each comprising an internal nucleus of silver bromide or silver iodobromide having a silver iodide content of not more than 1 mol %, having formed outside thereof, in an order of a first coating layer of silver iodobromide having a silver iodide content of from 2 to 20 mol % and a second coating layer of silver iodobromide or silver bromide with a silver iodide content which is lower than that of said first coating layer and is not more than 3 mol %, wherein said silver halide emulsion grains further comprise at least two high iodide phases formed by halogen conversion with iodide ion, by addition of silver iodide fine grains or by addition of silver ion and iodide ion, one of which is provided at any stage during formation of 3 to 97% of a total amount of silver, and the other is provided after complete formation of the second coating layer.

2. The silver halide light-sensitive emulsion as claimed in claim 1, wherein said silver halide grains have a total iodide content of not more than 5 mol %.

3. The silver halide light-sensitive emulsion as claimed in claim 1, wherein said silver halide grains are cubic, tetradecahedral or octadecahedral.

4. The silver halide light-sensitive emulsion as claimed in claim 1, wherein said silver halide grains have a coefficient of variation of size distribution of not more than 20%.

5. The silver halide light-sensitive emulsion as claimed in claim 1, wherein said silver halide grains have been subjected to selenium sensitization.

6. The silver halide light-sensitive emulsion as claimed in claim 1, wherein seed crystal grains are used for formation of the internal nucleus of said silver halide grains.

7. The silver halide light-sensitive emulsion as claimed in claim 1, wherein the high iodide phases of said silver halide emulsion grains are formed after formation of 3 to 97% of the total amount of silver, after complete formation of the first coating layer or after complete formation of the second coating layer.

8. The silver halide light-sensitive emulsion as claimed in claim 7, wherein said silver halide grains have a total iodide content of not more than 5 mol %.

9. The silver halide light-sensitive emulsion as claimed in claim 7, wherein said silver halide grains are cubic, tetradecahedral or octadecahedral.

10. A silver halide light-sensitive material having at least one silver halide emulsion layer on a support, in which at least one of the silver halide emulsion layers contains silver halide emulsion grains comprising an internal nucleus of silver bromide or silver iodobromide having a silver iodide content of not more than 1 mol %, having formed outside thereof, in order of a first coating layer of silver iodobromide having a silver iodide content of from 2 to 20 mol % and a second coating layer of silver iodobromide or silver bromide with a silver iodide content which is lower than that of said first coating layer and is not more than 3 mol %, said silver halide emulsion grains comprising at least two high iodide phases formed by halogen conversion with an iodide ion, by addition of silver iodide fine grains or by addition of a silver ion and an iodide ion, one of which is provided during formation of 3 to 97% of a total amount of silver, and the other is provided after complete formation of the second coating layer.

11. The silver halide light-sensitive material as claimed in claim 10, wherein said silver halide emulsion grains have a total iodide content of not more than 5 mol %.

12. The silver halide light-sensitive material as claimed in claim 10, wherein said silver halide emulsion grains are cubic, tetradecahedral or octadecahedral.

13. The silver halide light-sensitive material as claimed in claim 10, wherein said silver halide emulsion grains have a coefficient of variation of size distribution of not more than 20%.

14. The silver halide light-sensitive material as claimed in claim 10, wherein said silver halide emulsion grains have been subjected to selenium sensitization.

15. The silver halide light-sensitive material as claimed in claim 10, wherein seed crystal grains are used for formation of the internal nucleus of said silver halide emulsion grains.

16. A silver halide light-sensitive material as claimed in claim 10, characterized in that the layer containing silver halide grains is fogged.

17. A silver halide light-sensitive material as claimed in claim 10, wherein the layer containing the silver halide emulsion grains contains a compound represented by formula (1):

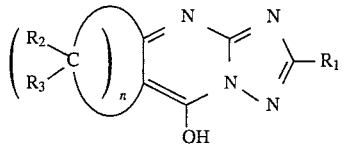

(1)

wherein $R_1$ represents a hydrogen atom, an aliphatic group, an aromatic group, a heterocyclic group, an amino group, a hydroxyl group, an alkoxy group, an alkylthio group, a carbamoyl group, a halogen atom, a cyano group, a carboxyl group or an alkoxycarbonyl group; $R_2$ and $R_3$ each represent a hydrogen atom, an aliphatic group, an aromatic group or a heterocyclic group; and n represents an integer of 3 to 5.

18. A silver halide light-sensitive material which comprises a support having theron at least one light-sensitive layer comprising a plurality of silver halide emulsion layers which has subtantially a same color-sensitivity but a different light-sensitivity, at least one of which contains silver halide emulsion grains comprising an internal nucleus of silver bromide or silver iodobromide having a silver iodide content of not more than 1 mol %, having formed outside thereof, in order of a first coating layer of silver iodobromide having a silver iodide content of from 2 to 20 mol % and a second coating layer of silver iodobromide or silver bromide a silver iodide content of which is lower than that of said first coating layer and is not more than 3 mol %, said silver halide emulsion grains further comprise at least two high iodide phases formed by halogen conversion with an iodide ion, by addition of silver iodide fine grains or by addition of a silver ion and an iodide ion, one of which is provided during formation of 3 to 97% of a total amount of silver, and the other is provided after complete formation of the second coating layer and wherein a tabular silver halide emulsion is present in a silver halide emulsion layer which is further from the support than those having the same color sensitivity.

* * * * *